US012662719B2

(12) United States Patent
Dhiba et al.

(10) Patent No.: US 12,662,719 B2
(45) Date of Patent: Jun. 23, 2026

(54) PROCESSES FOR THE RECOVERY OF URANIUM

(71) Applicant: OCP S.A., Casablanca (MA)

(72) Inventors: Driss Dhiba, Casablanca (MA); Mounir El Mahdi, Casablanca (MA); William W Berry, Lakeland, FL (US); Thomas E. Baroody, Lakeland, FL (US)

(73) Assignee: OCP S.A., Casablanca (MA)

( * ) Notice: Subject to any disclaimer, the term of this patent is extended or adjusted under 35 U.S.C. 154(b) by 624 days.

(21) Appl. No.: 17/800,185

(22) PCT Filed: Sep. 25, 2020

(86) PCT No.: PCT/US2020/052777
§ 371 (c)(1),
(2) Date: Aug. 16, 2022

(87) PCT Pub. No.: WO2022/066169
PCT Pub. Date: Mar. 31, 2022

(65) Prior Publication Data
US 2023/0064712 A1 Mar. 2, 2023

(51) Int. Cl.
*C22B 60/02* (2006.01)
*C22B 3/42* (2006.01)

(52) U.S. Cl.
CPC ..... *C22B 60/0265* (2013.01); *C22B 3/42* (2013.01)

(58) Field of Classification Search
None
See application file for complete search history.

(56) References Cited

U.S. PATENT DOCUMENTS

| | | | |
|---|---|---|---|
| 4,599,221 | A | 7/1986 | Ketzinel et al. |
| 9,702,026 | B2 | 7/2017 | Berry et al. |
| 2012/0189513 | A1 | 7/2012 | Rossiter |
| 2015/0203939 | A1 | 7/2015 | Berry et al. |

FOREIGN PATENT DOCUMENTS

| | | | | |
|---|---|---|---|---|
| EP | 0132902 | A2 * | 2/1985 | ..... C22B 60/0265 |
| GB | 2084126 | A | 4/1982 | |
| JP | H06339615 | A | 12/1994 | |
| WO | WO2015059445 | A1 | 4/2015 | |

(Continued)

OTHER PUBLICATIONS

El Gammal, E. M. and Ahmed, S. H. Separation and determination of uranium in phosphoric acid medium using high-performance ion chromatography. Journal of Radioanalytical and Nuclear Chemistry (2019) 321:413-419. (Year: 2019).*

(Continued)

*Primary Examiner* — Anthony J Zimmer
*Assistant Examiner* — Zachary John Baum
(74) *Attorney, Agent, or Firm* — Lee & Hayes, P.C.

(57) ABSTRACT

The present disclosure describes a method of recovering uranium including a continuous ion exchange (CIX) process including a single cycle or a dual cycle CIX process and at least a gradient elution or resin crowding process. The present disclosure also describes an apparatus including a single cycle or dual cycle CIX system and a gradient elution and/or resin crowding system.

26 Claims, 4 Drawing Sheets

(56) References Cited

FOREIGN PATENT DOCUMENTS

WO WO2018222414 A1 12/2018

OTHER PUBLICATIONS

Massart, D. L. Cation-exchange techniques in radiochemistry. National Academy of Sciences—National Research Council. NAS NS-3113 (1971). (Year: 1971).*
Daintith, John Martin, Elizabeth. (2010). Dictionary of Science (6th Edition)—weak acid. Oxford University Press. Retrieved from https://app.knovel.com/hotlink/pdf/id:kt007XB606/dictionary-science-6th/weak-acid. (Year: 2010).*
Examination Report for Canadian Application No. 3,193,726, Dated Jan. 20, 2025, 8 pages.
Office Action for Chiliean Application No. 2023-00866, Dated Jan. 3, 2025, 30 pages.
Office Action for Japanese Application No. 2023-519288, Dated Oct. 24, 2024, 12 pages.
Office Action for Japanese Application No. 2023-519288, Dated Apr. 25, 2025, 12 pages.
Office Action for Kazakhstan Application No. 2023/0266.1, Dated Nov. 26, 2024, 4 pages.
Office Action for Kazakhstan Application No. 2023/0266.1, Dated Feb. 20, 2025, 6 pages.
Examination Report for Saudi Application No. 522440880, Dated Oct. 23, 2024, 12 pages.
Office Action for Tanzania Application No. AP/P/2023/014774, Dated Apr. 19, 2025, 4 pages.
Moroccan Office Action mailed Mar. 7, 2023 for Moroccan patent application No. 57770, a foreign counterpart of U.S. Appl. No. 17/800,185, 8 pages.
European Search Report dated Sep. 29, 2023 in European Application No. 20955448.4, 9 pages.
Office Action for Kazakhstan Application No. 2023/0266, dated May 17, 2024, 12 pages.
Office Action dated Mar. 11, 2024 in Saudi Arabian Application No. 5224400880, 12 pages.
Iraqi Office Action mailed Sep. 20, 2022 for Iraqi Patent Application No. 505/2021, a foreign counterpart to U.S. Appl. No. 17/800,185, 4 pages.
International Search Report and Written Opinion mailed Dec. 30, 2020 for PCT application No. PCT/US20/52777, 13 pages.
Mahmood, Tariq, "Optimization of Ion-Exchange Chromatography with Multiple Gradient Inputs for Protein Separations," Jan. 1997, Thesis, New Jersey Institute of Technology, Chapter 2, pp. 12-13. 7 pages.
Colombian Office Action mailed May 2, 2023 for Colombian patent application No. NC2023/0003753, a foreign counterpart of U.S. Appl. No. 17/800,185, 2 pages.
Saudi Arabian Office Action mailed May 28, 2023 for Saudi Arabia patent application No. 522440880, a foreign counterpart of U.S. Appl. No. 17/800,185, 12 pages.
Office Action for Vietnam Application No. 1-2023-02407, Dated Apr. 18, 2025, 4 pages.
Office Action for Korean Application No. 10-2023-7013291, Dated Aug. 8, 2025, 18 pages.
Office Action for Australian Application No. 2020468925, Dated Oct. 8, 2025, 4 pages.
Office Action for United Arab Emirates Application No. P6000700/2023, dated Nov. 13, 2025, 10 pages.
Office Action for Isreali Application No. 301601, Dated Nov. 5, 2025, 10 pages.
Office Action for Pakistan Application No. 699/2021, Dated Dec. 3, 2025, 2 pages.
Office Action for Korean Application No. 10-2023-7013291, dated Feb. 23, 2026, 8 pages.
Office Action for Chilean Application No. 2023-00866, Dated Apr. 1, 2026, 4 pages.
Office Action for Brazilian Application No. BR1120230055725, dated Apr. 2, 2026, 10 pages.

* cited by examiner

PROCESSES FOR THE RECOVERY OF URANIUM

CROSS REFERENCE TO RELATED APPLICATIONS

This application is a U.S. National Phase Application of International Application No. PCT/US2020/052777 filed Sep. 25, 2020, which is hereby incorporated by reference in its entirety.

TECHNICAL FIELD

The present disclosure relates to processes and methods for the recovery of uranium.

BACKGROUND

Uranium is an important heavy metal that is used in many ways in our daily lives. As an example, uranium provides nuclear fuel to generate electricity in nuclear power stations. It also is used as a radioisotope industrially, in medicine for diagnostic purposes, in the preservation of food, and in growing crops and breeding livestock. Uranium is found in the earth's crust, in rocks, and in seawater and can be recovered from the oceans. However, it is not sufficiently concentrated in seawater to be economically recoverable.

Uranium (U) is also found in phosphate rock, and different processes have been developed for the recovery of uranium from phosphoric acid that is produced from phosphate rock. Three of the processes include: the DEPA-Topo process developed at Oak Ridge National Laboratories, which uses di(2-ethylhexyl) phosphoric acid and trioctyl phosphine oxide as extractants; the OPAP process, also developed at Oak Ridge National Laboratories, which uses octyl phenyl acid phosphate as the extractant; and the OPPA process, developed by Dow, which uses octyl pyro phosphoric acid as the extractant. However, these processes are based on solvent extraction (SX) technology wherein the extractant is dissolved on some sort of diluent, e.g. high-grade kerosene-like solutions, then used in this diluted form for the recovery process. There is an interest in developing a non-solvent extraction system to eliminate operational issues associated with these solvent extraction systems, especially the potential for traces of solvent to enter the phosphoric acid process after the U extraction process which could result in major problems in rubber-lined equipment.

Phosphoric acid is an alternate source of uranium depending on the starting content of Uranium in the phosphate rock. The presence of uranium in wet-process phosphoric acid has been well established, and the recovery of uranium from wet-process phosphoric acid has also been practiced commercially. Moreover, ion exchange systems have been used to recover uranium, and fixed bed ion exchange systems have been used effectively to recover uranium from various conventional sulfate and carbonate solutions (non-phosphate ore sources). Typically these solutions are produced from the leaching of various ores or from the so-called "in-situ" leaching where a leaching solution is injected in the ground to leach the U-bearing material and then recovered in a pumped well system.

U.S. Pat. No. 9,702,026 discloses a process for the recovery of uranium from wet-process phosphoric acid using single or dual cycle continuous ion-exchange (CIX) system. Although the prior art CIX systems simplify the recovery of uranium from wet-process phosphoric acid, improvements are still needed to enhance the purity of the recovered uranium.

SUMMARY

The present disclosure describes an improved method for recovering uranium which involves the process of gradient elution and/or resin crowding. In embodiments, gradient elution and the resin crowding are used in combination with one or more CIX processes. In embodiments, the method includes a single CIX process (a single cycle CIX process) including a gradient elution or resin crowding process. In embodiments, the method includes two CIX processes (a dual cycle CIX process), each including a gradient elution or resin crowding process or only one of the CIX processes includes a gradient elution or resin crowding process.

The present disclosure also describes a CIX apparatus including a single or dual cycle CIX system and at least a gradient elution or a resin crowding system for recovering uranium.

Figure 3:
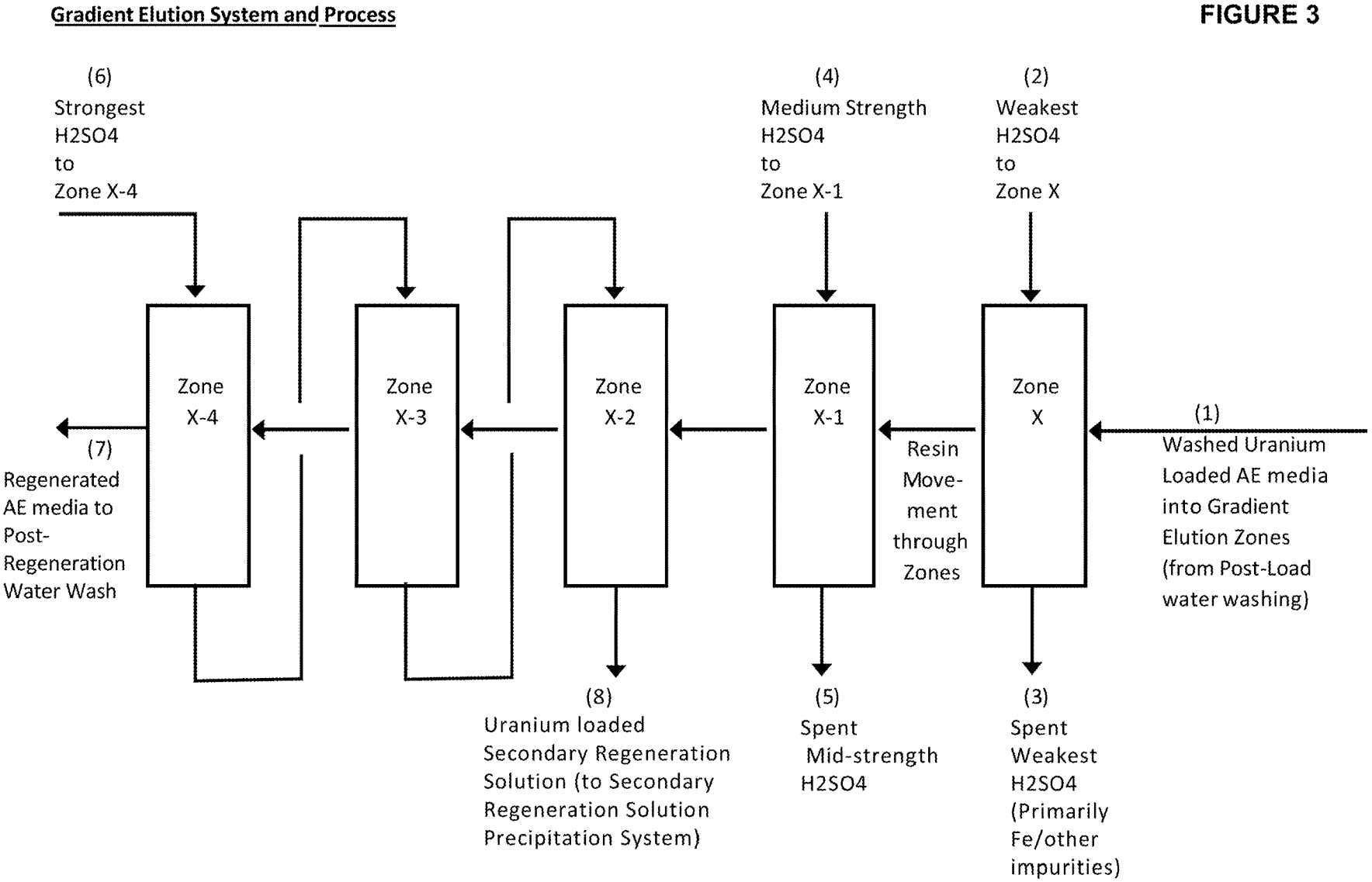
FIG. 3 shows an exemplary gradient elution system and process, which can be part of the single or dual cycle CIX process shown in FIG. 1 and FIG. 2. In this exemplary gradient elution process, the gradient elution process is included as part of the secondary CIX process of the dual cycle CIX process, which includes an AE (i.e. Anion Exchange) resin media. The AE media (1) has been loaded with uranyl carbonate complex from the primary regeneration solution. As the resin proceeds from Zone X to Zone X-1, increasing strength of an exemplary acid (2) to (4), sulfuric acid, is added to the resin to remove contaminants loaded on the AE media with the uranyl carbonate. At Zone X-2, uranium loaded secondary regeneration solution is produced. The AE media is finally regenerated with the strongest acid (6) and washed with water before reentry to the secondary CIX process.
Figure 4:
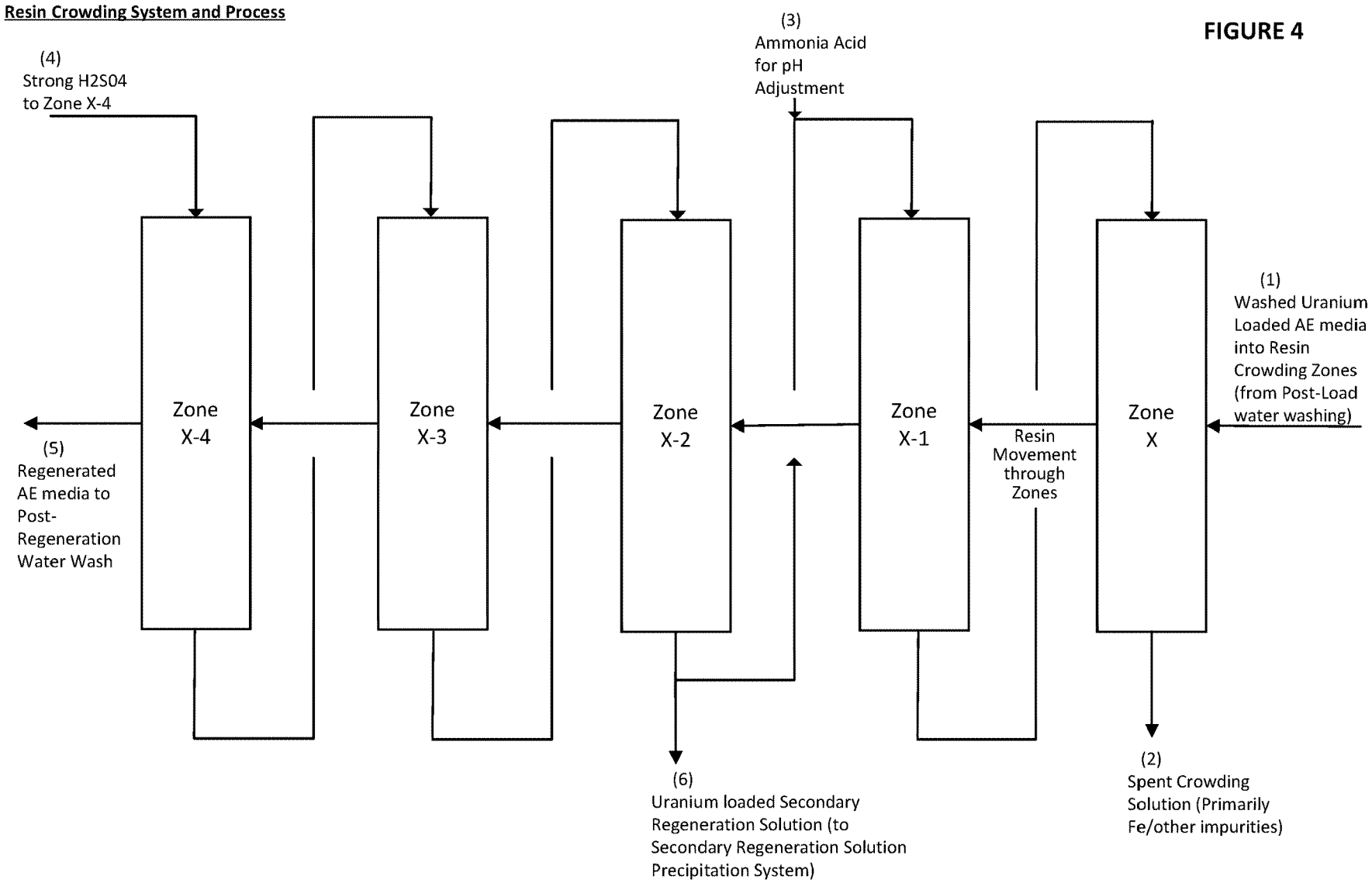
FIG. 4 shows an exemplary resin crowding process, which can be part of the single or dual cycle CIX process shown in FIG. 1 and FIG. 2. This exemplary resin crowding process is part of the secondary CIX process of the dual cycle CIX process, which includes an AE resin. The AE media (1) has been loaded with uranyl carbonate complex from the primary regeneration solution. A portion of the uranium loaded secondary regeneration solution is adjusted with a weak base (3), such as ammonia, and applied to the AE media. As the media proceeds from Zone X to Zone X-2, uranium in the secondary regeneration solution, which has been converted to an anionic form because of the pH adjustments, loads onto the AE media and displaces the contaminants on the AE resin. At Zone X-2, uranium loaded secondary regeneration solution is produced. The AE resin is finally regenerated with a strong acid (4) and washed before reentry to the CIX process.

In both FIG. 3 and FIG. 4, depending on how the secondary CIX system is configured, Zone X could be any zone, such as Zone 27 in a system that had a total of, say, 30 zones. Since there is a considerable degree of flexibility inherent in the possible configurations that can be used for optimized operation, "X" is used to denote a specific zone of the secondary CIX system. Zone X to Zone X-4 are part of the gradient elution or resin crowding system.

DETAILED DESCRIPTION

The present disclosure describes apparatus and process for recovering uranium from a source that involve a combination of one or more CIX processes and at least a gradient elution or resin crowding process to enhance the purity of the obtained uranium. In embodiments, the apparatus and process for recovering uranium described herein include a CIX apparatus and a gradient elution and/or resin crowding system. The CIX apparatus (and process) described herein includes a single cycle or a dual cycle CIX apparatus (and process) and a gradient elution and/or resin crowding system (and process). In embodiments, the single cycle CIX apparatus has a single CIX (primary CIX) system, and the dual cycle CIX apparatus has two CIX systems, a primary CIX system and a secondary CIX system. In embodiments, the gradient elution process and/or resin crowding process can be used in either or both cycles of the dual cycle CIX apparatus.

The terms "recovering," "isolating," "removing," "extracting," and "purifying" are used interchangeably to refer to obtaining a product, such as uranium from a source. In embodiments, recovering uranium includes obtaining uranium in various chemical forms including uranyl oxides, uranyl carbonates, uranyl hydroxides, ammonium uranyl compounds including ammonium uranyl tricarbonate, and the like. Recovering uranium also includes obtaining uranyl ions. The term "uranium" or "U" as used herein, refers to uranium in various chemical forms.

The source of uranium can be any source containing uranium. The source of uranium used in the methods described herein includes a source of phosphoric acid containing uranium, such as a phos-acid ($P_2O_5$) or phos-acid feedstock. In embodiments, the source of phosphoric acid is from wet-process (WP) phosphoric acid. WP phosphoric acid is obtained by decomposing recovered phosphate ore with sulfuric acid and filtering the obtained slurry. Depending on the nature of the phosphate ore, the bulk of the uranium that may be contained in the ore is dissolved and reports to the phosphoric acid stream. WP phosphoric acid is used to manufacture over 90% of the phosphoric acid in the world. The electric furnace process (EFP) is used to produce the rest of the phosphoric acid. Most of the phosphoric acid produced by WP is used for fertilizer production. WP phosphoric acid is less pure, less concentrated, and much less expensive to produce than EFP phosphoric acid. A small percentage of WP phos-acid is processed, typically in a different solvent extraction process, to produce higher quality, i.e. technical-grade or even food-grade phos-acid). Phosphoric acid produced by EFP (95-100%) is used for various industrial and food uses. EFP phosphoric acid is much purer, more concentrated, and much more expensive to produce than WP phosphoric acid. Also, EFP produced phosphoric acid contains no uranium, as all of the uranium in the raw material phosphate rock reports to the slag waste product in the process.

In embodiments, any phosphate ore that can be processed to produce WP phos-acid and contains some level of uranium is suitable as the source for recovering uranium.

In embodiments, the source of uranium includes uranium in any chemical and oxidation state or form. "Uranium in any chemical and oxidation state" refers to uranium that is dissolved into the source. As an example, the uranium dissolved in phosphoric acid during the preparation of phos-acid from the reaction of phosphate rock and sulfuric acid in the phos-acid plant. The uranium can be in either the +4 or the +6 oxidation state, and most likely exists as a cationic complex which can be extracted by an ion exchange media.

CIX systems and processes were developed in the early 1980's. With the advancement of technology, second and third generation CIX systems have been developed which use less water and consume less chemicals, thus reducing operation costs. Continuous ion exchangers have multiple resin chambers which can be configured to allow for a multitude of processing steps. For example, there may be several chambers configured for the extraction step in a process. This can be followed by the configuration of chambers to allow for resin washing, resin regeneration, and the like. The ion exchange for extraction of one or more components from the feed solution generally takes place first, which transfers the desired ion onto the column. This is generally followed by a water washing step to remove entrained feed solution from the resin. This is followed by the regeneration of the column and the removal of the extracted ions from the column. After regeneration, another water wash step is used to minimize loss of any regeneration solution. The advantage of a CIX system includes washing and regeneration of resin media without interruption of the ion exchange process. In addition, there is inherent flexibility in the approach that allows additional process steps to be incorporated into the CIX system configuration, e.g. multiple regeneration solutions, post-treatment of the resin after loading and before water washing, and the like. These added process configurations are not practical with other ion exchange contacting systems, such as fixed-bed units. Further, this flexibility allows for totally different approaches to assessments for ion exchange applications to processes that in the past were not considered practical (with the earlier contacting systems).

A primary difference between the CIX apparatus and processes described herein and the prior art methodologies, for example, the solvent extraction method, is that in the CIX apparatus and processes described herein, a solid, polymeric, functionalized material is used to extract the uranium from the source. No liquid extractants and diluent solvents, such as high-grade kerosene, are used. Therefore, problems associated with emulsion formation and fire/explosion risk are essentially eliminated. The elimination of the need for organic diluents, such as kerosene, also eliminates the potential for downstream damage in the existing operations that would result from entrained solvent materials.

The processes and systems for both the chelating or complexing cationic exchange (CE) and anionic exchange (AE) described below are carried out in a continuous ion exchange (CIX) equipment system. The system used is a continuous operation wherein there are multiple solid media chambers and multiple feed and discharge ports to/from the system that allow for continuous solution feeds and discharges. The system is such that ports can be configured in a variety of manners and once in operation the solid media chambers are transferred from one port or zone area to another without interruption of any process flow.

In embodiments, examples of the type of CIX system includes the Calgon ISEP system developed in the early 1980s (U.S. Pat. No. 4,522,726). In this system, there is a fixed inlet and discharge distributor arrangement that directs fluids to/from the system. There are multiple resin chambers which are situated on a rotating table that moves the chambers from one zone to the next. Another example would be the IONEX unit which has a modified inlet/outlet fluid distribution arrangement that allows for the resin chambers to remain stationary and via the modified distribution systems moves the fluids from one chamber to the next to provide the sample response as that in the systems utilizing a rotating platform to move the chambers. These types of systems are essential to carry out the multiple steps needed to carry out this process.

The more conventional types of ion exchange systems, such as the fixed bed units utilizing manifolds for fluid distribution are not sufficiently flexible and are limited in the number of process steps that can be carried out from a practical standpoint. Likewise, the so-call semi-continuous ion exchange systems, such as the "pulse-bed" units wherein the resin is periodically pulsed from one section of the unit to another, do not allow for truly continuous fluid flows and operational response. The nature of the process is such that multiple steps have to be carried out without interruption and the overall complexity of the ion exchange equipment system needs to be minimized. The truly continuous systems such as those mentioned satisfy this requirement.

Moreover, in the apparatus and processes described herein, the source of uranium, for example, the phosphoric acid source, can be returned to the phosphoric acid facility. The apparatus and processes described herein include regeneration of the media using a regeneration agent or a combination of agents.

Further, in the case of CIX, there is no need for additional post treatment of the solid media used in the ion exchange column, since the solid media (i.e., the resin or equivalent materials) have no solubility in the source of uranium. Additionally, the uranium contained in the solid media is subsequently removed in the regeneration stage of the process described herein.

Single Cycle Continuous Ion Exchange (CIX) Apparatus and Process

Figure 1:
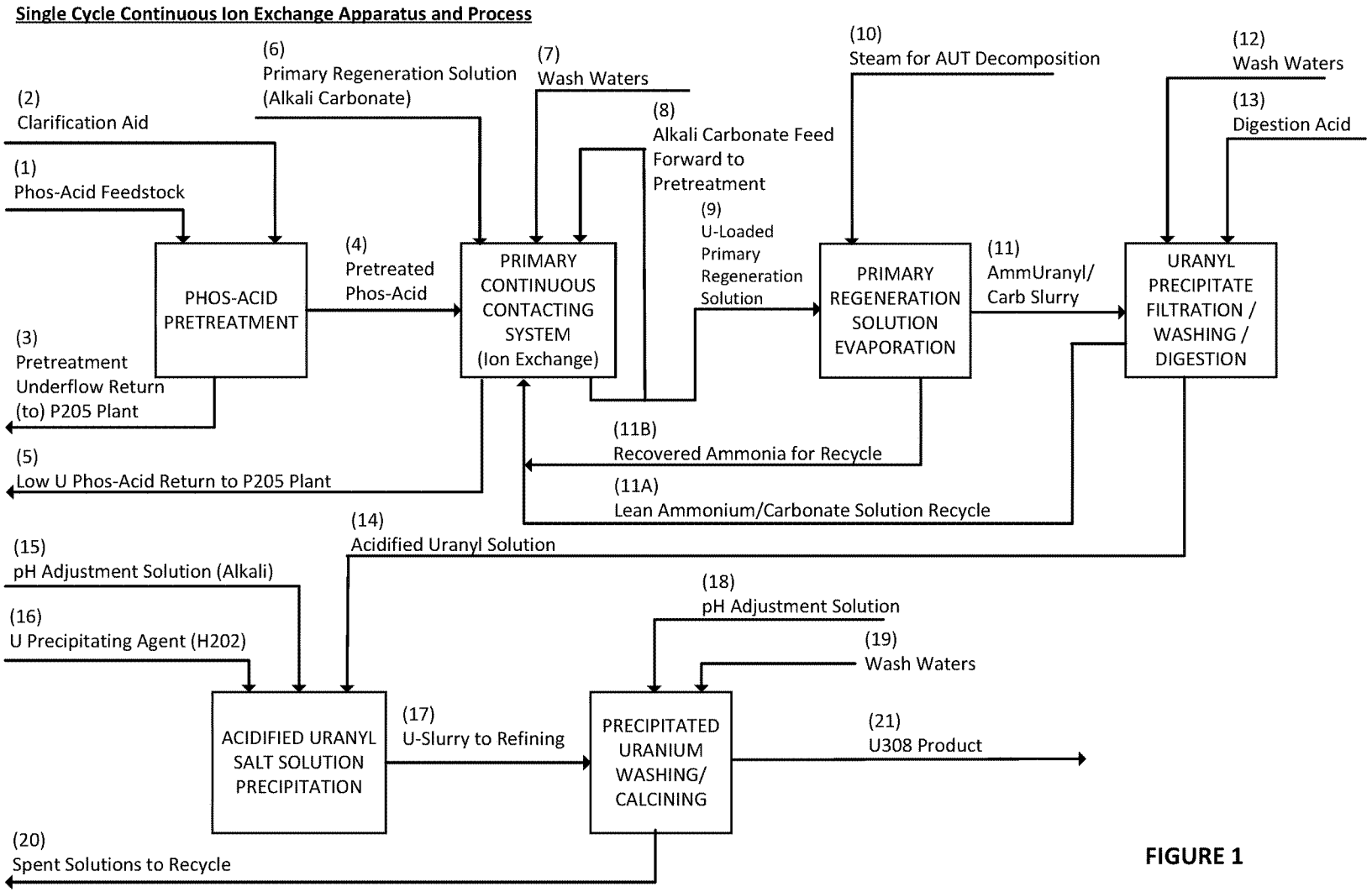
FIG. 1 shows an exemplary single cycle CIX apparatus and process for uranium recovery. The basic process blocks are shown along with the major material inputs and outputs. Stream numbers for the description are noted as (stream #) in the figure. A gradient elution system or the resin crowding system can be included in the Primary CIX system.

The process of recovering uranium described herein includes a single cycle CIX apparatus and process. In the single cycle CIX process, a solid contacting media is used to extract uranium from the source of uranium in a single CIX cycle. An exemplary embodiment of the single cycle CIX apparatus and process is shown in FIG. 1.

In embodiments, the single cycle CIX apparatus includes the following major systems (ports):

- Pretreatment System, which can include cooling the source of uranium and filtering and/or clarification of the source of uranium;
- Primary Continuous Contacting (or Primary CIX) System, which contains the the primary CIX system, along with the systems required for preparation of the primary pretreatment and regeneration solutions (of the primary CIX system) and the normally associated peripheries, for example, surge tanks, aqua ammonia preparation, ammonium carbonate preparation (which is the primary regeneration solution), water wash feeding systems, and the like;
- Gradient Elution and/or Resin Crowding System (subport or subsystem), can be part of the primary continuous contacting system for further removal of contaminants from the source of uranium;
- Primary Regeneration Solution Evaporation System, which is required for concentrating the primary regeneration solution and reducing the pH by excess ammonium carbonate decomposition;
- Uranyl Precipitate Filtration, Washing, and Digestion System, which is where the precipitated uranyl material is filtered, washed, then digested with an acid solution to dissolve the uranyl compound and produce an acidified uranyl salt solution;
- Acidified Uranyl Salt Solution Precipitation (Uranium Precipitation) System, which is where the acidic uranyl salt solution is pH adjusted, and the soluble uranium precipitated as an insoluble uranyl compound; and
- Precipitated Uranium Washing and Calcining System, which is where the insoluble uranyl compound is washed, and subsequently, the uranyl compound is dried and calcined to produce a form of uranium, for example, uranium oxide.

The single cycle CIX process can also include uranium storage and automatic packaging systems and steps which are standard operations and are not described here in detail. The single cycle CIX process uses the single cycle CIX apparatus to recover uranium. The single cycle CIX process is described below.

Pretreatment System and Process: The pretreatment system (and process) is not required but can be used to remove suspended solids from the source of uranium to minimize build-up of solids in the system. If the source of uranium does not contain suspended solids, then the pretreatment system (process) is not necessary. Using phos-acid as the source of uranium, the pretreatment system is used in the CIX process to remove suspended solids from the phos-acid. The source of uranium is treated in a clarification system to remove suspended solids in the source to a specific target level or less than about 1,000 ppm. The clarified source is then treated in a polish filtration system where trace solids are reduced to a level of less than 100 ppm. It is important to note that some level of solids is tolerable in the CIX process, unlike fixed bed ion exchange or solvent extraction systems, since there is a routine, and sometimes frequent, "cleaning" step within the CIX operation itself. The incoming source of uranium (1) may be cooled and subsequently treated for removal of suspended solids and minor color-bodies. The solids can be returned to the original source. For example, the solids from the phos-acid source (source of uranium), can be returned to the phos-acid facility. The cooling system is optional and can be site specific.

In embodiments, pretreating the source of uranium in the pretreatment system includes addition of activated clay to the phos-acid from the gypsum/phos-acid separation filter and followed by the addition of a flocculent material to coagulate solids, with the resulting mixture sent to a clarification (settling) system. The clarified acid is then treated in a polishing filter to remove residual trace amounts of solids. Typically activated clays can be used, but other coagulating materials may also be used instead of activated clay, such as activated silica, activated carbon powder, and the like. The organic flocculent is added to enhance the clarification of the solids. The main function of the addition at this point is to provide aid to enhance the coagulation of the suspended solids in the feed source to enhance the ultimate settling of the solids from the liquid.

In embodiments, the pretreatment system (process) includes systems (processes or steps) for clay addition, a flocculent addition, and clarification, which is followed by a system (process or step) for polishing filtration. All these systems (processes) are for the removal of solids from the source of uranium.

Primary Continuous Contacting (or Primary CIX) System: The primary CIX system (and process) performs two steps, the ion exchange extraction step to remove the target species, i.e. uranium in this case; and the regeneration of the solid media. The source of uranium (4), optionally the pretreated source of uranium, first enters the primary CIX system where it is contacted with a continuous system including an appropriate primary solid media. As the source of uranium passes through the primary solid media, the soluble uranium is transferred from the source to the solid media. The mechanism can be an ion exchange transfer, and the uranium can be in the cationic form when it is extracted from the source and transferred to the solid media. The source of uranium (5), which is now low in uranium, can then be returned to the plant. As an example, the source of uranium can be a source of phosphoric acid which is returned to the phosphoric acid plant after the transfer of uranium to the primary solid media. It should be noted that there may be some dilution of the source material so an evaporation unit can be included for the removal of small amounts of water from the source material. The uranium loaded primary solid media is first washed with process water (7) to remove entrained source solution from the resin. It is then regenerated by treatment with an alkali carbonate solution (6) to convert the uranium to an anionic uranyl carbonate complex which transfers from the solid media to the solution phase. The treatment then results in a regenerated primary solid media and uranium loaded primary regeneration solution including the anionic uranyl carbonate complex (9). In embodiments, the solid media in the primary CIX system is an ion exchange media.

The gradient elution or resin crowding system (and process), which are described in detail below, are a subsystem (subprocess) of the primary CIX system.

The primary solid media for extracting the uranium from the source can be any material that chelates or complexes uranium from the source. The primary solid media includes a chelating or complexing cationic exchange (CE) media. As described earlier, the primary solid media removes the uranium from the source in a cationic form. The primary solid media can be a primary CIX resin. Examples of useful resins and/or equivalent materials for the primary solid media include:

- a weakly acidic CE resin with chelating aminomethyl phosphonic acid groups for the selective recovery of transition heavy metals, such as LEWATIT® TP 260™ (Lanxess, Maharashtra, India);
- an aminophosphonic chelating resin (Dow; Rohm & Haas, Philadelphia, PA), such as AMBERLITE IRC-747™;
- a macroporous polystyrene based chelating resin, with iminodiacetic groups designed for selective recovery of cations of heavy metals, such as S-930™ (Purolite resin, Bala Cynwyd, PA); and,
- a composition or a material including an agent having chelating groups, functionalities, or moieties that bind uranium, for example, an iminodiacetic group, an aminomethyl phosphonic acid group, an aminophosphonic group, or similar chelating functionalities or moieties. Optionally, the composition or material includes beads, wires, meshes, nanobeads, nanotubes, nanowires or other nano-structures, or hydrogels. The agent can also be a non-resin solid or a semi-solid material.

In embodiments, the primary solid media can be any resin or equivalent material including one or more chelating groups, functional groups, or moieties that bind uranium from the source. In embodiments, the chelating groups, functional groups, or moieties bind uranium with high affinity from phosphoric acid. Examples of one or more such groups or moieties include an iminodiacetic group, an aminomethyl phosphonic group, and an aminophosphonic group.

Prior to regeneration, the primary solid media is pretreated. The primary solid media loaded with uranium from the primary contacting step is washed with a small amount of water (7), and then transfers into the regeneration pretreatment step of the primary CIX process. During this portion of the primary CIX process, the uranium loaded primary solid media is contacted with a small amount of the alkali carbonate solution (8) exiting the regeneration subsystem (of the primary CIX system) to prepare the primary solid media for regeneration. The alkali carbonate solution (8) is a portion of the uranium loaded regeneration solution that is recycled. The spent pretreatment solution is combined with the uranium loaded primary regeneration solution exiting the system (9).

The pretreatment of the primary solid media can also use a portion of the uranium loaded primary regeneration solution that initially exits the regeneration system. This initial solution has a low uranium content and effectively neutralizes any residual acid in the primary solid media. This is critical so that when the primary solid media enters the regeneration stage there is no residual acid that can react with the alkali carbonate solution and reduce its pH.

Further, if there is any uranium in the pretreatment solution, this uranium will reload onto the solid media, prior to its entry into the regeneration system. This has the further effect of allowing for some level of uranium separation from the contained contaminants by crowding the ion exchange sites with uranium.

It has also been discovered that by operating a portion of the pretreatment step of the primary CIX process in an up-flow mode, the primary solid media can be expanded during each cycle. This expansion allows for regular cleaning of the solid media and enables the CIX apparatus to handle a much higher level of solids than either the fixed bed system or alternative solvent extraction system. Any solids accumulated in the system are then flushed from the system and transferred to the spent pretreatment solution storage area, and then the solids are disposed. In embodiments, the initial pretreatment solution exiting the up-flow section of the CIX can contain solids and are transferred to the spent pretreatment solution storage area. The solids can be disposed of as is or the spent pretreatment solution is filtered to dispose of the solids and to retain any uranium in the spent pretreatment solution.

After the regeneration pretreatment step, the pretreated primary solid media is contacted with an alkali carbonate solution (6) to remove the uranium and return the primary solid media to its extraction form. In this step, the alkali carbonate solution converts the uranium to an anionic (extraction form), an anionic uranyl carbonate complex, which has no affinity for the primary solid media. The uranium thus transfers from the primary solid media in its extraction form, to the alkali solution phase which forms the uranium loaded primary regeneration solution (9). The resulting regeneration solution (9) is then transferred to an evaporation system (the primary regeneration solution evaporation system) for the concentration of the anionic uranyl carbonate solution. The concentration of uranium in the primary regeneration solution (9) is increased significantly because the resulting volume of primary regeneration solution is considerably less than the source of uranium loaded on the solid media.

The regenerated primary solid media is washed with water before returning to the primary CIX process.

In embodiments, suitable alkali carbonate solutions include ammonium carbonate, sodium carbonate, potassium carbonate, and the like. The choice of the appropriate solution is based on compatibility with the plant and the entire process. In embodiments, ammonium carbonate is the alkali carbonate used as it produces ammonium uranyl tricarbonate (AUT) which will decompose in the downstream evaporation/decomposition process and reduce the pH of the loaded regeneration solution thus allowing for uranium precipitation. It is critical that the pH during the regeneration stage be above a minimum value. In embodiments, the pH of the uranium loaded primary regeneration solution is greater than about pH 9.0. If the pH falls below the minimum value, the uranium in the uranium loaded primary regeneration solution may reload onto the primary solid media. The minimum value depends on the alkali carbonate solution chosen. As an example, ammonium carbonate solution has a pH in the range of about pH 9.8 to about pH 10.5 due to the addition of ammonium, which is acceptable for this process.

In embodiments, if the alkali carbonate solution (6) used to remove the uranium from the primary solid media and to form an anionic uranyl complex is ammonium carbonate, then the anionic uranyl complex formed is ammonium uranyl tricarbonate and the resulting uranium loaded primary regeneration (9) solution includes an ammonium uranyl tricarbonate solution.

Primary Regeneration Solution Evaporation System and Process: In this system (and process), the anionic uranyl carbonate solution is concentrated by evaporation. In embodiments, the uranium loaded primary regeneration solution (9) is heated in an evaporation system using indirect steam (10) to concentrate the AUT and decompose excess alkali carbonate to reduce the pH of the solution. In embodiments, the alkali carbonate solution is ammonium carbonate; thus, the primary regeneration solution (9) containing AUT is heated in an evaporation system using indirect steam to concentrate the AUT and decompose excess ammonium carbonate to reduce the pH of the solution via the evolution of the ammonia from the solution. As the pH is reduced the solubility of the uranium is reduced which results in the formation of a uranyl precipitate. The alkali component, for example, the ammonia, resulting from the decomposition (11B) is recovered and recycled, and the resulting solution is combined with the lean alkali carbonate stream (11A). This allows for a high degree of recycling within the system and minimization of any resulting spent solutions. While other alkali carbonates can be used, the ammonium carbonate is preferred since the nature of the resulting AUT is such that upon heating, the ammonia component decomposes and evolves from the solution resulting in a pH reduction which results in a decrease in the solubility of the uranium in the solution. This is an important factor since with the AUT system heating and evaporation will decompose the AUT. Other alkali carbonate systems, such as sodium and potassium carbonates, can be used with reducing the pH of the uranium loaded primary regeneration solution (9), which requires the use of some form of acid to result in uranyl precipitation.

The primary regeneration solution evaporation system also includes a condenser for recovering decomposed compounds, for example, ammonia, from the regeneration solution to allow for the recycling of the compound.

Uranyl Precipitate Filtration/Washing/Digestion System and Process: In this system (and process), the uranyl precipitate (11) is first filtered, then washed with a small amount of water (12) to form a filter cake. The washed filter cake is then digested with an acid (13) to dissolve the uranium and produce an acidified uranyl salt solution. Acids that can be used to digest the filter cake include sulfuric, nitric, hydrochloric, and the like. Organic acids, such as acetic, glycolic, and the like also, can be used but in the context of general recovery, these organic acids are not practical and are expensive. An important aspect of the process described herein is to be able to use acids that are most likely going to be in the other operations of the phos-acid production process to minimize the introduction of new materials into the overall plant. As an example, sulfuric acid is used if the source of the phosphoric acid facility uses $H_2SO_4$. From a production volume standpoint, the bulk of the phosphoric acid plants in the world use $H_2SO_4$ as the digestion media for the phosphate rock. The resulting acidified uranyl salt solution (14) is then transferred to the precipitation system (acidified uranyl salt solution precipitation system) for precipitation of uranium. The lean solution, containing lower pH alkali carbonate, can be recycled (11A) to the primary CIX system and can be combined with recovered alkali or anionic component (11 B) and reused.

In this system, there is a filtration subsystem to filter the uranyl precipitate, a washing system to wash the uranyl precipitate to form a filter cake, and a digestion system to digest the filter cake with an acid to dissolve the uranium and produce an acidified uranyl salt solution.

Acidified Uranyl Salt Solution Precipitation System and Process: In this uranium precipitation system (and process), the acidified uranyl salt solution (14) is combined with an alkali solution (15), such as ammonium hydroxide, to increase the pH of the solution to a pH of about 2.5 to about pH 7.0, or between about pH 3.5 to about pH 6. After the pH adjustment, a uranium precipitating agent (16), such as hydrogen peroxide is added, and a uranyl peroxide precipitate or slurry is formed (17). The uranyl precipitate or slurry is then transferred to the washing and calcining operation (Precipitated Uranium Washing and Calcining System).

Other alkali solutions that can be used include sodium hydroxide, potassium hydroxide, and sodium or potassium carbonates.

Although hydrogen peroxide is the preferred precipitating agent for producing high quality uranium oxide, other precipitating agents can be used. For example, ammonium hydroxide, ammonium carbonate, sodium hydroxide, sodium carbonate, or potassium hydroxide can be used as the precipitating agent. These precipitating agents can be used with increasing the pH of the solution to 7 or above. As an example, the use of ammonium hydroxide would result in the formation of ammonium diuranate compound at a higher pH, which may include higher levels of impurities that need to be removed. Moreover, the preferred uranium compound is uranium oxide, which is formed with hydrogen peroxide as the precipitating agent. Other forms of uranium formed with other precipitates have limited uses, other than for power and defense.

Precipitated Uranium Washing/Calcining System and Process: In this system (and process), as the uranyl precipitate (17) enters this process step, a small amount of pH adjustment reagent (18) is added to adjust the pH of the precipitate. If the pH of the precipitate is low, for example below pH 2, then an alkali solution can be used for the adjustment. If the pH is too high, for example, above pH 5, then a small amount of acidic solution can be added. An example of an alkali solution for increasing the pH includes ammonium hydroxide, and an example of an acidic solution for decreasing the pH includes sulfuric acid.

This mixture is then clarified, and the thickened uranyl precipitate is washed with a small amount of water (19). The uranyl solid is then centrifuged, and the recovered uranyl solid is transferred to a dryer/calciner system where the uranyl solid is decomposed to produce a uranium oxide product (21). Optionally, the process as described herein can further include separating the uranyl precipitate from the solution phase by settling, filtration, centrifugation, or similar procedures, then washing the uranyl precipitate with water. The washing can include washing the uranyl precipitate on a filter, or repulping the uranyl precipitate with water, followed by settling or filtration or centrifugation or similar procedures, and optionally further including additional washing of the uranyl precipitate with water to remove the bulk of any entrained secondary solution (uranium-free) via additional filter washing, washing within a centrifuge, or optionally additional repulping with water followed by settling.

In embodiments, the precipitating agent used is hydrogen peroxide, so the uranyl precipitate formed is uranyl peroxide ($UO_4 \cdot 2H_2O$). The process described herein includes optionally separating the uranyl peroxide from the solution phase by settling, filtration, centrifugation, or equivalents, then washing the uranyl peroxide with water. The process described herein further includes drying the uranyl peroxide in a dryer/calciner system to form a dry solid material. In the dryer/calciner system, the uranyl peroxide is heated to a temperature sufficient to decompose, or calcine, the uranyl peroxide and form a uranium oxide compound, for example, $U_3O_8$.

It should be noted that the precipitated uranium at this stage is a uranyl peroxide compound which can be washed and dried without calcining to produce a dry U-peroxide material if desired. Typically, however, the materials are calcined to produce the uranium oxide (U3O8) to produce a standard product for the trade.

The spent solution from washing the uranyl precipitate is collected and is filtered. In embodiments, the spent solution is recycled to up-stream processes to minimize the overall plant aqueous spent solution volume (20).

In embodiments, the calcined oxide product ($U_3O_8$) is lightly milled then surged and loaded into drums for storage and shipment. A contained drum loading system can be used to minimize the potential for dust emission.

Dual Cycle Continuous Ion Exchange (CIX) System and Process

Figure 2:
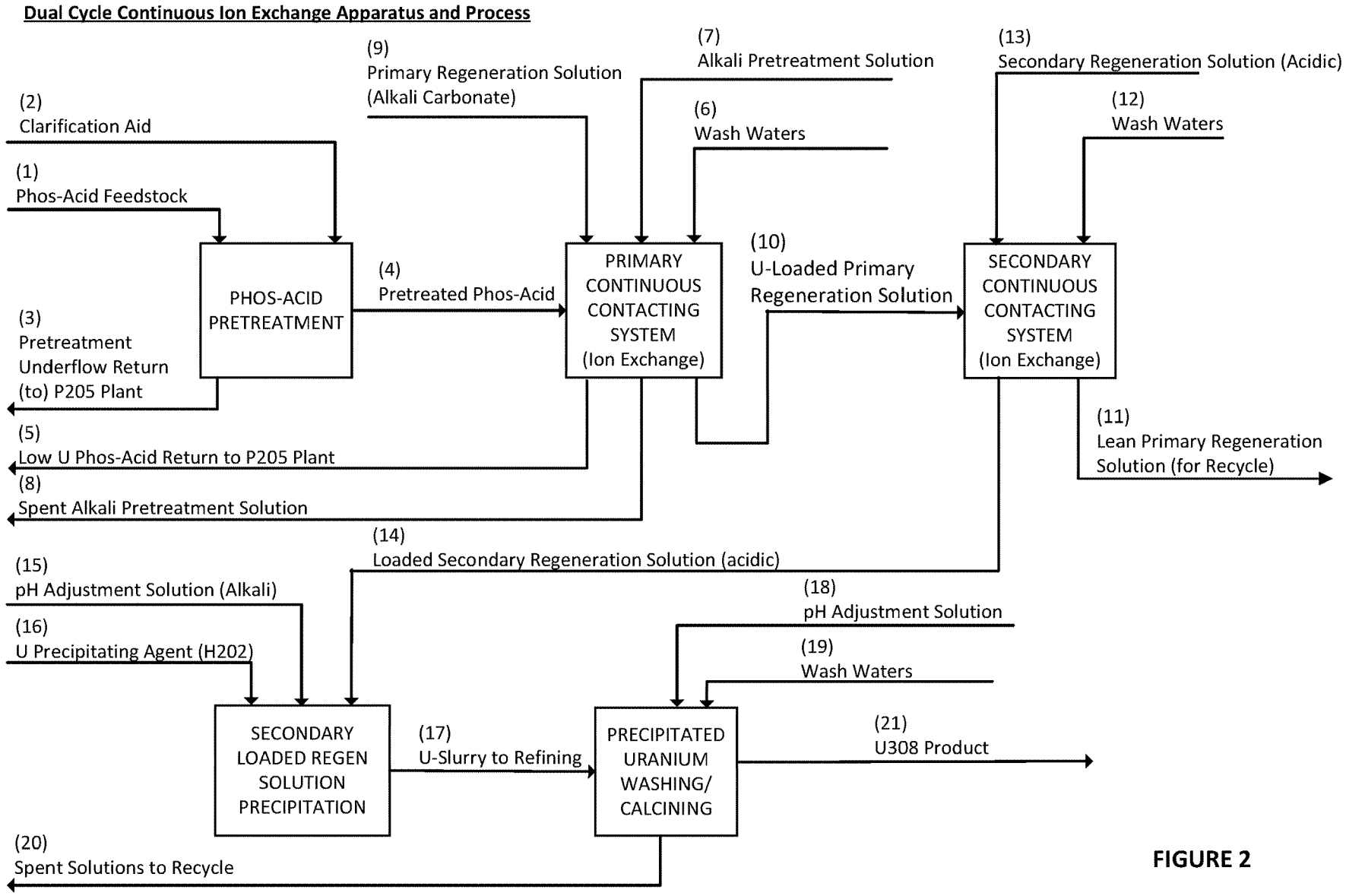
FIG. 2 shows an exemplary dual cycle CIX apparatus and process for uranium recovery. The basic process blocks are shown along with the major material inputs and outputs. Stream numbers for the description are noted as (stream #) in the figure. A gradient elution system or the resin crowding system can be included in the Primary CIX system and/or the Secondary CIX system.

The process of recovering uranium described herein also includes a dual cycle CIX apparatus and process. In the dual cycle CIX process, two separate solid contacting media are used to extract uranium from the source of uranium. An exemplary embodiment of the dual cycle CIX apparatus and process is shown in FIG. 2.

In embodiments, the dual cycle CIX apparatus for uranium recovery can be divided into the following major systems (ports):

- Pretreatment System, which can include acid cooling the source of uranium and filtering and/or clarification of the source of uranium; Primary Continuous Contacting (or Primary CIX) System, which contains the primary CIX system along with the systems required for preparation of the primary pretreatment and regeneration solutions (of the primary CIX system) and the normally associated peripheries, for example, surge tanks; regeneration solution preparation (for example, ammonium carbonate); regeneration pretreatment solution preparation (for example, ammonium hydroxide); and the like;
  - Gradient Elution and/or Resin Crowding System (subport or subsystem) can be part of the primary continuous contacting system for further removal of contaminants from the source of uranium;
- Secondary Continuous Contacting (or Secondary CIX) System, which contains the secondary CIX system along with the systems required for preparation of the secondary pretreatment regeneration solutions (of the secondary CIX system) and the normally associated peripheries as discussed above;
  - Gradient Elution and/or Resin Crowding System (subport or subsystem) can be part of the secondary continuous contacting system for further removal of contaminants from the source of uranium;
- Secondary Regeneration Solution Precipitation System, which is where the secondary uranium loaded regeneration solution is pH adjusted, and the soluble uranium compound is precipitated as an insoluble uranyl compound; and
- Precipitated Uranium Washing and Calcining System, which is where the insoluble uranyl compound is washed, and subsequently, the uranyl compound is dried and calcined to produce a form of uranium, such as uranium oxide.

The dual cycle CIX process can also include uranium storage and automatic packaging systems and steps which are standard operations and are not described here in detail. The dual cycle CIX process uses the dual cycle CIX apparatus to recover uranium. The dual cycle process is described below.

In embodiments, at least one of the primary CIX system or the secondary CIX system includes the gradient elution or resin crowding system. In embodiments, both the primary CIX system and the secondary CIX system includes a gradient elution or resin crowding system.

Pretreatment System and Process: The process of pretreatment is as described above for the single cycle CIX and therefore is not be repeated here.

Primary Continuous Contacting (or Primary CIX) System: Similar to the primary CIX system (process) of the single cycle CIX, the primary CIX system (and process) of the dual cycle CIX performs two steps, the ion exchange step and the regeneration of the solid media. The source of uranium (4), optionally the pretreated source of uranium, first enters the primary CIX system where it is contacted in a continuous system including an appropriate primary solid media. As the source of uranium passes through the primary solid media, the soluble uranium is transferred from the source to the solid media. The mechanism can be an ion exchange transfer, and the uranium can be in the cationic form when it is extracted from the source and transferred to the solid media. The source of uranium (5) which is now low in uranium can then be returned to the plant. As an example, the source of uranium can be a source of phosphoric acid which is returned to the phosphoric acid plant after the transfer of uranium to the solid media. The uranium loaded primary solid media is then regenerated with an alkali carbonate solution (9) to convert the uranium to an anionic uranyl carbonate complex to produce a regenerated primary solid media and a uranium loaded primary regeneration solution including the anionic uranyl carbonate complex.

The gradient elution or resin crowding system (and process), which are described in detail below, can be included as a subsystem (subprocess) of the primary CIX system.

The primary solid media for extracting the uranium from the source can be any material that chelates or complexes uranium from the source and have been previously described under the single cycle CIX. Therefore, the information is not repeated here.

Prior to regeneration, the primary solid media is pretreated. The primary solid media loaded with uranium is washed with a small amount of water (6), which is internally contained, then transfers into the regeneration pretreatment step of the primary CIX process. During this portion of the primary CIX process, the uranium loaded primary solid media is contacted with an alkali pretreatment solution (7) to prepare the media for regeneration. The alkali pretreatment solution used during the regeneration pretreatment step is a weak alkali solution, such as ammonium hydroxide, to neutralize any residual free acid in the solid media. The spent alkali pretreatment solution (8) is sent to the wastewater system or can be recycled for other uses. Other weak alkali solutions that can be used include weak sodium hydroxide, weak potassium hydroxide, and the like. However, due to its compatibility with the CIX processes and its general use within many phosphoric acid complexes, especially where ammonium fertilizers are being produced, the weak ammonium hydroxide is preferred.

Following the pretreatment of the primary solid media, the uranium loaded primary solid media is regenerated with an alkali carbonate solution (9) to convert the uranium to an anionic uranyl carbonate complex, which has no affinity for the primary solid media, and to produce a uranium loaded primary regeneration solution (10) in addition to the regenerated primary solid media. Examples of alkali carbonate solutions include ammonium carbonate, sodium carbonate, and potassium carbonate. The choice of the appropriate alkali solution is based on compatibility with the plant and the entire process. In embodiments, the anionic uranyl carbonate complex is an ammonium uranyl tricarbonate complex when the alkali carbonate solution is ammonium carbonate. As indicated, the steps being carried out in the primary stage of the dual cycle CIX process is essentially the same as the CIX operation in the single cycle approach.

The uranium thus transfers from the primary solid media to the alkali carbonate solution phase. The resulting uranium loaded primary regeneration solution is a smaller volume as compared to the volume of the source of uranium used and contains a higher concentration of uranium in the solution. The resulting uranium loaded primary regeneration solution (10) is then transferred to the secondary CIX system. The concentration of uranium in the primary regeneration solution (10) is increased significantly because the resulting volume of primary regeneration solution is considerably less than the source of uranium loaded on the solid media.

The regenerated primary solid media is washed with water before returning to the primary CIX process.

As mentioned in the single cycle CIX process, it is critical that the pH in the regeneration stage be above a minimum value because if the pH falls below a certain level, the uranium in the primary regeneration solution may reload onto the primary solid media. The information regarding the criticality of the pH during the regeneration stage is not repeated here.

Moreover, similar to the single cycle CIX process, by operating a portion of the pretreatment in an up-flow mode, the primary solid media can be expanded during each cycle which allows for regular cleaning of the solid media and enables the CIX process to handle a much higher level of solids than either the fixed bed system or alternative solvent extraction system. Any solids accumulated in the system are then flushed from the system and transferred to the spent pretreatment solution storage area, and then eventually the solids are disposed. In embodiments, the initial pretreatment solution exiting the up-flow section of the CIX can contain solids and are transferred to the spent pretreatment solution storage area. The solids can be disposed of as is or the spent pretreatment solution is filtered to dispose of the solids and to retain any uranium in the spent pretreatment solution.

Secondary Continuous Contacting (or Secondary CIX) System and Process: In this system (and process), the uranium loaded primary regeneration solution (10) is contacted with a secondary CIX solid media (a second ion exchange system), utilizing a strong anion resin to extract the uranium from the primary regeneration solution and load it onto a strong anion resin. The secondary regeneration solution is an acid other than phosphoric acid and can be inorganic acids such as sulfuric acid ($H_2SO_4$); nitric acid ($HNO_3$); hydrochloric acid (HCl); and the like. $H_2SO_4$ is the preferred acid in this case since it is used within most (but not all) phosphoric acid facilities as the acid source for the digestion of the phosphate rock to produce the so-called wet-process phosphoric acid. The secondary CIX system can be considerably smaller than the primary CIX system, and a different solid media can be used. However, the principles of operation are similar to those used in the primary CIX system.

The uranium (anionic uranyl carbonate) contained in the primary regeneration solution (10) is transferred to the secondary solid media. The secondary solid media includes a strong anionic ion exchange resin (AE) media or equivalent material. Thus, the secondary solid media has a high affinity for the anionic uranyl carbonate complex in the primary regeneration solution (10). In embodiments, the lean primary regeneration solution from the secondary system (11) is recycled to the maximum extent possible.

Strong anion exchange resins have been used commercially for the treatment of conventional uranium-bearing solution sources, e.g. those produced in some of the widespread in-situ uranium leaching processes. In the current disclosure, the use of the AE is being incorporated into a novel process for the recovery of uranium from phosphoric acid. The AE is used after the uranium has been removed from the phos-acid and transferred to another solution phase, such as ammonium carbonate. Use of the "conventional" ion exchange approaches, i.e. conventional cationic or anion resins, directly with phos-acid is not practical to the highly complex nature of the uranium in the phos-acid media. Thus, a more powerful technique, such as the complexing or chelating ion exchange resin is required to remove the uranium from the phos-acid. Once the uranium is transferred to a more "conventional" solution phase, such as ammonium carbonate, then approaches based on modifications to some of the current techniques, such as anionic exchange, can be used. Although some of the chemistry for the second CIX of the dual cycle CIX system is similar to conventional methods, there are still necessary adaptations, such as how the secondary extraction and subsequent regeneration are incorporated into the overall processing system, to have an integrated process approach.

The gradient elution or resin crowding system (and process), which are described in detail below, can be included as a subsystem (subprocess) of the secondary CIX system.

The secondary solid media can be any strong anionic ion exchange material that extracts the anionic uranium from the primary loaded regeneration solution with a corresponding ion exchange between the anion on the regenerated anionic resin, for example, a sulfate ($SO_4$) anion, for the anionic uranium complex in the primary loaded regeneration solution (10), e.g. the uranyl carbonate anion. The secondary solid media should be a strongly anionic ion exchange material. Examples of resins or equivalent material for the secondary solid media include:

- a strongly basic anion exchange resin with a type II quaternary ammonium functional group for selective recovery of anionic heavy metal complexes, such as LEWATIT® K6267™ (Lanxess, Maharashtra, India);
- established strong anion resins in the conventional uranium recovery industry such as Dow-Rohm/Haas 21K;
- a strongly basic anion exchange resin with a type I quaternary ammonium functional group for selective recovery of anions, such as PUROLITE A-600™ (Purolite, Bala Cynwyd, PA); and
- a composition or material including an agent having one or more chelating groups, functionalities, or moieties that bind the anionic uranyl complex. As examples, the chelating groups, functionalities, or moieties include a type I or type II quaternary ammonium functional group. Optionally, the composition or material includes beads, wires, meshes, nanobeads, nanotubes, nanowires or other nano-structures, or hydrogels. The agent can also be a non-resin solid or a semi-solid material.

In embodiments, the secondary solid media can be any resin or equivalent material containing a type I or type II quaternary ammonium functional group.

In embodiments, the secondary solid media includes a strongly anionic anion group, such as the sulfate $(SO_4)^{-2}$ group, which carries out the uranium extraction via anion exchange of the strongly anionic anion, e.g. the $(SO_4)^{-2}$, via the transfer of the anionic group from the resin (solid) phase, to the liquid phase in exchange for the anionic uranyl carbonate species originally in the primary loaded regeneration solution from the primary CIX system. Note that other strongly anionic groups can be used, e.g. nitrate ($NO_3$), or chloride (CI). However, the preferred material is $H_2SO_4$ since it is generally the most prevalent acid solution used in the phos-acid industry.

The loaded secondary solid media is then subjected to regeneration pretreatment by washing with water (12). The washed media is then regenerated by contacting with a secondary regeneration solution (13) that is a strong acid, such as $H_2SO_4$, but has been diluted with water to produce a lower concentration acidic solution for use as the regeneration material. The uranium loaded secondary regeneration solution (14), now containing a high concentration of uranium, is then transferred to the uranium loaded secondary regeneration solution precipitation system. The regenerated secondary solid media is washed with water before returning to the secondary CIX process. After the water wash, the solid media is washed with a small amount of weak ammonium hydroxide (not shown) to neutralize any traces of $H_2SO_4$ that might remain in the media. This is done so that the pH of the resin media entering the secondary loading, or extraction section of the CIX is in the same range as that of the loaded regeneration solution obtained from the primary CIX system. In this manner, the uranyl carbonate is maintained as the strong anion in the primary solution (10) feeding the secondary cycle.

In the initial start-up, the uranium loaded secondary regeneration solution (14) may not be of sufficient purity. The initial uranium loaded secondary regeneration solution (14) can be recycled and/or stored. Under normal circumstances, even with plant shutdowns, once the process is underway there will be purified solutions available for storage and use in the restart of the plant.

The use of an acidic secondary regeneration solution enhances the secondary regeneration by ensuring that all of the uranium is reconverted to a cationic form, which has no affinity for the anionic secondary solid media. In embodiments, the secondary regeneration solution (13) can be a dilute sulfuric acid, a dilute nitric acid, a dilute hydrochloric acid, or an equivalent solution. The acid chosen for the secondary regeneration solution depends on the acid source used for the production of the phosphoric acid and if there are any unique circumstances associated with the particular uranium recovery operation. In embodiments, when the source of uranium is a source of phosphoric acid, then a sulfuric acid is used, due to its compatibility with the existing phosphoric acid operations. With this system, the acidic materials are used for regeneration. However, other regeneration solutions have been used in other applications. Typically, these will be neutral salts of the strong acid materials. These would include salts such as ammonium sulfate, ammonium nitrate, ammonium chloride, sodium chloride, sodium nitrate, sodium sulfate, potassium salts, and the like. For the recovery of uranium from the phosphoric acid system, $H_2SO_4$ is the preferred regeneration solution for the secondary CIX anion exchange.

In embodiments, if the ammonium carbonate is used as the primary regeneration solution in the primary CIX process and sulfuric acid is used as the secondary regeneration solution in the secondary CIX process, the cationic form of the uranium in the uranium loaded secondary regeneration solution is acidic ammonium uranyl sulfate solution.

In the past, there were concerns about the use of a low pH solution for the regeneration of the anionic media because residual carbonate solution remaining in the media after the secondary loading would react with the acid and decompose to form a salt and release carbon dioxide within the media bed. However, by performing a CIX approach as described herein, a portion of the regeneration system can be operated in an up-flow mode; and by operating the initial regeneration contact in this mode there is some level of decomposition and the released carbon dioxide actually assists in the expansion of the media bed and allows for a level of media cleaning at the beginning of the secondary regeneration stage.

The use of the up-flow mode is discussed above for the pretreatment regeneration of the primary CIX process. In embodiments, the CIX process described herein includes the use of up-flow modes which can be operated with or without the assistance of air to assist the up-flowing liquid in expanding the media bed and loosening accumulated solids, so that they can be flushed from the solid media. In the case of the secondary CIX process, the release of carbon dioxide within the media bed allows for "in-situ" gas formation and subsequent solid media scouring.

The regenerated secondary solid media can be treated with water to remove entrained acidic regeneration solution. The secondary solid media can be further post treated with an alkali solution (not shown) to neutralize any residual acid in the media before reentry into the secondary CIX process. Typically, this alkali solution would consist of weak ammonium hydroxide, similar to that used in the primary CIX system following the post-loading water wash to remove traces of phos-acid acidity from the loaded resin prior to the ammonium carbonate regeneration step.

Secondary Regeneration Solution Precipitation System and Process: In this precipitation system (and process), the uranium loaded secondary regeneration solution (14) is combined with an alkali solution to increase the pH of the uranium loaded secondary regeneration solution to about pH 2.5 to about pH 7.0 or to between about pH 3.5 to about pH 6. After the pH adjustment, a precipitating agent (16) is added and a uranyl precipitate or slurry is formed. The uranyl precipitate or slurry is then transferred to the precipitated uranium washing and calcining system for decantation, washing, and calcining.

Examples of alkali solution that can be used to increase the pH of the uranium loaded secondary regeneration solution include ammonium hydroxide, potassium hydroxide, and sodium hydroxide. Ammonium hydroxide is the preferred alkali since it is generally used elsewhere in the process so can be made up at a single point for use throughout the process. The alkali solution can have a concentration of 10% to 30%. Optionally, the alkali solution has a pH of greater than 10 in its solution form.

An example of a precipitating agent includes hydrogen peroxide. In embodiments, when hydrogen peroxide is added to the pH adjusted uranium loaded secondary regeneration solution, the uranyl precipitate formed is uranyl peroxide. The hydrogen peroxide is added in an amount sufficient to form a uranyl peroxide and to allow for the excess peroxide to be present in the solution to ensure complete uranyl peroxide precipitation. It is important to note that $H_2O_2$ is used as the precipitating agent since uranyl peroxide will precipitate from uranium-bearing solutions at pH's that are somewhat acidic. For example, with pH adjustment of the loaded secondary solution to pH 3 to 4, the peroxide material will precipitate. Equally important is that there can be many of the other impurities that might be present in the secondary loaded solution that will not precipitate under acidic conditions; thus, they remain in the solution phase. In this manner, a further degree of uranium purification is achieved.

There are other methods for precipitating the uranium from the secondary loaded solution that involves the addition of an alkali solution, such as ammonium hydroxide, and raising the pH of the solution to a level above 7, to form a slight alkali solution. In such a case, the uranium can be precipitated as an ammonium uranyl diuranate. Sodium or potassium hydroxide can also be used for alkali precipitation. These precipitating agents can be used with increasing the pH of the solution to 7 or above. As an example, the use of ammonium hydroxide would result in the formation of ammonium diuranate compound at a higher pH, which may include higher levels of impurities, which will need to be removed.

Moreover, the preferred product is uranium oxide, formed using hydrogen peroxide as the precipitating agent. Thus, the use of the hydrogen peroxide precipitation is the preferred route that imparts minimal impurity since the precipitation occurs under slightly acidic conditions.

Precipitated Uranium Washing/Calcining System and Process: In this system (and process), the pH adjustment, washing, and calcining of the uranyl precipitate to form, for example, uranium oxide compound or uranium, is discussed under single cycle CIX process. Therefore, the information is not repeated here.

The final product would be uranium oxide. This product would be similar to $U_3O_8$ produced from conventional uranium recovery operations using various uranium ores as the feedstocks (not phosphoric acid).

Many parts of the dual cycle and single cycle CIX procedures can be identical, for example, the acid cleanup, most of the primary extraction, and from the precipitation and drying sections to the end product. One main difference between the two processes is that in the dual cycle, there is a second CIX system, whereas, in the single cycle, there is a single CIX system. In the single cycle CIX process, the second CIX system is essentially replaced with the primary regeneration solution evaporation system and a different treatment of the concentrated primary regeneration solution to make the acidified uranyl solution, which is common to both processes ((14) in each Figure). From there, the processes are substantially the same.

Gradient Elution (GE) and Resin Crowding (RC) Systems and Processes

It has been found that some contaminants load onto the solid media with the uranium and are eluted off with the uranium when the regeneration solution is applied at the regeneration stage. Thus, the uranium loaded primary and secondary regeneration solutions often include contaminants in addition to uranium. As an example, the source of uranium, such as phos-acid, may include dissolved iron. A small portion of the iron can be co-extracted with the uranium onto the primary CIX chelating resin. While the percentage of dissolved iron in the acid that is co-extracted is small, the starting amount of iron can be high so that relative to the uranium recovery there is still a good portion of iron that loads onto the primary resin with the uranium.

The present disclosure describes processes for further removal of the contaminants to enhance the purity of the recovered uranium obtained from the single and dual cycle CIX processes. These processes include gradient elution (GE) and resin crowding (RC). The GE and RC processes remove contaminants before the removal of uranium from the solid media, which reduces the contaminants in the final uranium product resulting in a higher quality of uranium product. Both of these processes take advantage of the strong affinity of uranium for the CIX media as compared to the contaminants which result in selective removal of the contaminants from the uranium.

Gradient Elution (GE) System and Process: In the GE system (and process), a weak solution of the alkaline carbonate regeneration solution, in the case of the primary CIX system, or a dilute solution of the acidic regeneration solution that would be used for the secondary CIX system, is applied to the solid media during the pretreatment of the solid media. The selection of an appropriate solution of acid or base depends on whether the solid media is a chelating or complexing cationic ion exchange (CE) media or an anionic ion exchange (AE) media. In the case of an AE media, which is in the secondary CIX system, a dilute acidic solution is used for the removal of anions, which are non-uranium anions, from the media. The concentration of the acid solution would start at a value less than ⅓ that of the actual solution that would be used for regeneration of the resin and removal of the uranium. The pH would be slightly higher than the actual regeneration solution, on the order of 1 pH point. The non-uranium anions have a lower affinity for the AE media than the uranyl complex bound to the AE media. Thus, even with dilute regeneration solutions, many of the non-uranium ions can be removed from the strong anion resin. For the uranium recovery process, it has been discovered that in this system, the uranium has some of the highest affinity for the resins compared to the other ions that are present. Thus, by initially treating the resin with a solution that is weaker than that required to remove the uranium, a portion of the non-uranium ions can be removed. After the initial treatment with the weakest acidic solution, the process continues with applying increasing strength of the dilute acidic solution to the AE media to continually remove the non-uranium anions from the AE media until a practical point is reached where additional acid treatment will begin to remove uranium along with any residual impurity materials. The maximum allowable strength for the gradient solution material would depend on the actual operating conditions, but from an approximate standpoint, the maximum strength would be estimated at 40% of the actual strength of acid that would be used for the regeneration and removal of the uranium. These values can vary but can be determined empirically and can be controlled.

There are various known methods for producing dilute acidic gradient solutions of various strengths. Examples of dilute acidic solution that can be used with the AE media in GE include dilute sulfuric acid, dilute hydrochloric acid, and dilute nitric acid. The acid chosen depends on its compatibility with the rest of the process. In embodiments, when the source of uranium is a source of phosphoric acid, sulfuric acid is the most suitable acid for the entire process and system.

In the case of a complexing or chelating cationic exchange (CE) media (in the primary CIX system), a dilute basic solution is used. In this case, the solution is prepared by diluting some of the primary alkali regeneration solution (ammonium carbonate). The same process as described above is used for the dilute basic solution including increasing the strength of the dilute basic solution to remove the non-uranium cations which have lower affinity for the CE media. Examples of dilute basic solution that can be used with the CE media include dilute ammonium carbonate, dilute sodium carbonate, and dilute potassium carbonate. The base chosen depends on its compatibility with the rest of the process. In embodiments, the alkali solution is ammonium carbonate since it is the solution that would be used for the primary regeneration step The single and dual cycle CIX processes described herein can include a GE process in the primary and/or secondary CIX process. In the single cycle CIX process, the solid media in the primary CIX process is a CE media. Therefore, a dilute basic solution is an appropriate solution to use for gradient elution. Similarly, the solid media in the primary CIX process of the dual cycle CIX is a CE media, so the appropriate solution is also a dilute basic solution. However, the solid media in the secondary CIX process of the dual cycle CIX is an AE media. Accordingly, in a GE process, the appropriate solution to use with an AE media is a dilute acidic solution.

The GE process takes place during the regeneration pretreatment step of the primary CIX media or secondary CIX media, which occurs after the uranium is loaded on the primary or secondary CIX media and before regeneration of the primary or secondary CIX media. In embodiments, GE takes place during the primary regeneration pretreatment step of the primary CIX process of both the single and dual cycle CIX process. GE begins after the CE media, the primary CIX media, loaded with uranium has been washed with a small amount of water. In embodiments, during GE of the primary CIX process, increasing strength of a dilute basic solution, such as a dilute carbonate solution, is used to remove non-uranium cations. The strength of the dilute basic solution is increased until the bulk of the contaminants are removed from the CE media, but the uranium is left on the resin to be removed in the primary regeneration step. The dilute basic solution includes dilute ammonium carbonate solution, dilute sodium carbonate solution, or dilute potassium carbonate solution. In embodiments, the dilute basic solution is dilute ammonium carbonate solution.

After removal of the bulk of the contaminants, the CE media is ready for regeneration which involves converting the uranium on the CE media to an anionic uranyl carbonate using an alkali carbonate (primary regeneration solution) as discussed earlier.

The GE process can also take place during the secondary regeneration pretreatment step of the secondary CIX process of the dual cycle CIX process. Similar to the primary CIX process, GE can begin after the AE media, the secondary CIX media, loaded with uranyl carbonate complex has been washed with a small amount of water. In embodiments, during GE of the secondary CIX process, increasing strength of a weak sulfuric acid solution is used to remove non-uranium anions. The strength of the dilute sulfuric acid solution is increased until the bulk of the contaminants have been removed, but the uranium is not removed at this stage and left on for removal in the regeneration step.

After removal of the bulk of the contaminants, the AE media is ready for regeneration which involves converting the uranium on the AE media to a cationic form using the secondary regeneration solution, a weak acid, as described herein.

In embodiments, if the ammonium carbonate is used as the primary regeneration solution in the primary CIX process and sulfuric acid is used as the secondary regeneration solution in the secondary CIX process, the cationic form of the uranium in the uranium loaded secondary regeneration solution is acidic ammonium uranyl sulfate solution.

In embodiments, the GE process takes place in the primary or the secondary CIX process of the dual cycle CIX process. In embodiments, the GE process takes place in both the primary and the secondary CIX process of the dual cycle CIX process. Use of the technique in both of the cycles in a dual cycle system provides further assurances of contamination control.

In embodiments, the GE system which performs the GE process includes several zones within the CIX system itself. In each zone, a different strength of acid or base can be applied to the CE or AE media to remove a portion of the contaminants. The GE system would be carried out before the actual regeneration step. Following the GE portion of the process, the solid media would then enter the actual regeneration zones within the CIX system for treatment of the solid media with the alkali or acidic regeneration solution and removal of the uranium from the solid media with subsequent conversion of the solid media to the form needed for return to the loading portion of the process. The GE system can include one to fifty zones. The GE system can include one, two, three, four, or five zones. The GE system can include one to 50 zones, five to 45 zones, ten to 40 zones, 15 to 35 zones, 20 to 34 zones, 22 to 33 zones, or 24 to 32 zones. The number of zones used for GE will depend on the specific system and the extent of contamination control required.

FIG. 3 shows an example of the GE system and process including zones and used with the secondary CIX process to remove anionic contaminants. The chamber containing AE media (1) loaded with uranyl carbonate complex (from the primary regeneration solution) enters Zone X of the GE process. Note that the zones are referred to as X, X-1, etc. This convention was chosen to allow for focus on the GE steps without regard to which actual zone it might be in a commercial system. Depending on the process, there may be several zones, for example, 24 to 32, for in a given commercial unit. Thus, rather than picking a zone number for the explanation, the generic method was used. In some processes, zone X might be the actual zone 24 in a specific case. In this case, zone X-1 would be zone 23. In another process, the zone numbers may be different. Thus use of X; X-1; etc. eliminates the need for specific numbering. The important point to recognize is that the resin chambers are moving from right to left in this example, i.e. from zone X then to zone X-1; etc. The AE media (1) is contacted with a solution of sulfuric acid solution (2) that is considerably weaker than the acid strength used for the actual removal of the uranium from the resin. The weakest sulfuric acid solution passes through the resin and removes anions that have a lower affinity for the resin than the uranyl carbonate complex. The spent weakest solution (3) is then discharged from the system.

The chamber containing the solid media then transfers to Zone X-1. In Zone X-1 the resin is contacted with a medium strength sulfuric acid solution (4). The strength of the solution is controlled such that additional contamination is removed from the resin, but again the acid in this zone is weaker than that needed for removal of uranium from the resin. The spent medium strength sulfuric acid (5) is also discharged from the system.

Depending on how the uranium recovery apparatus is incorporated into the phos-acid complex, there may be opportunities to utilize these spent solutions in other operations within the overall phosphate production facility. These are factors that may be advantageously employed to enhance the economic attractiveness of the process to a specific phos-acid operation.

After the medium strength sulfuric acid treatment, the chamber containing the solid media is then transferred to Zone X-2. In this zone, regeneration solution that has been used to counter-currently contact the solid media chambers in zones X-4 and X-3 is collected from zone X-3 and fed to zone X-2 for a final regeneration contact. The uranium loaded secondary regeneration solution exiting zone X-2 is transferred (8) to the uranium loaded secondary regeneration solution precipitation system. In Zone X-2 through X-4, the AE media is contacted in a counter-current fashion with the strongest sulfuric acid (6) which is fed from Zone X-4 to Zone X-3 then to Zone X-2. This counter-current contacting approach is used to maximize the potential concentration of uranium in the uranium loaded secondary regeneration solution (8) exiting the CIX system as well as providing for efficient regeneration of the media with minimal amounts of fresh regeneration solution.

The regenerated AE media (7) is then transferred to a post-regeneration water washing step and finally returned to the secondary CIX system, where it is again contacted with fresh, primary loaded regeneration solution obtained from the primary CIX system.

The GE process enables the treatment of the primary or secondary media for selective removal of anions from the resin. As an example, by taking advantage of the affinities of the various anions for the AE resin of the secondary CIX system, varying strengths of sulfuric acid can be used to separate the contaminants from the AE resin before the U is removed. As indicated, the same process concept can be applied to the primary CIX system except, in this case, an alkali carbonate solution, e.g. ammonium carbonate, is used instead of an $H_2SO_4$ solution. The operating concept is the same. The only difference is that with the primary system and the alkali carbonate gradient is used.

Resin Crowding (RC) System and Process: The RC process can take place during the regeneration pretreatment step of the primary CIX media or secondary CIX media, which occurs after the uranium is loaded on the primary or secondary CIX media and before regeneration of the primary or secondary CIX media. The single cycle or dual cycle CIX process described herein can also include an RC system (and process). In the single cycle CIX process, RC can take place during the regeneration pretreatment step of the primary CIX process. In the dual cycle CIX, RC can take place during one or both of the primary and secondary regeneration pretreatment steps of the primary and secondary CIX process.

In the primary CIX system (and process) of both the single and dual cycle CIX processes, RC can begin after the CE media (the primary CIX media) loaded with uranium has been washed with a small amount of water. A portion of the uranium loaded primary regeneration solution, either recycled/stored or initial start-up uranium loaded regeneration solution (of low purity), is pH adjusted with a dilute sulfuric acid solution. The pH adjustment converts the anionic complex uranium in the solution to a cationic form so that it has an affinity for and can be reloaded onto the CE media. The pH adjusted solution (the crowd solution) is applied to the CE media. Due to the affinity of uranium for the CE media relative to the other ions present, the uranium in the crowd solution displaces the non-uranium contaminants, which results in the CE media being more completely loaded with uranium before regeneration. It is important to note that with a relatively minor pH reduction in the loaded primary regeneration solution the uranium component will reload onto the primary CE media. This sensitivity was discovered during the regeneration testing of the primary CE media with an ammonium carbonate solution. If there was a pH reduction in the regeneration solution, for any reason, then the uranium would not be removed from the CE media, but rather the uranium that was in the regeneration solution would load back onto the CE media. This was obviously a negative impact on the regeneration efficiency but indicated the potential for a minor pH adjustment to a portion of the primary loaded regeneration solution to allow for reloading onto the resin and "crowd" off the non-uranium ions on the CE media before full regeneration.

Examples of dilute acids that can be used to reduce the pH in a portion of the primary loaded regeneration solution (ammonium uranyl carbonate) to produce a small amount of crowd solution for RC in the primary CIX process include sulfuric acid, nitric acid, and hydrochloric acid. In embodiments, sulfuric acid is used because it is most compatible with the process system using phosphoric acid as the source of uranium. Upon addition of the dilute acid to a portion of the primary loaded regeneration solution (ammonium uranyl carbonate) the pH of the solution is reduced to a target value. Typically, the loaded regeneration solution has a pH in the range of 10.0 to 10.5. With slight acidification, the pH of the portion that would be used for crowding is reduced to about 8.0 to 8.5. Under these conditions, the contained uranium is in a non-anionic form.

After crowding, the bulk of the non-uranium contaminants have been removed and additional uranium reloaded onto the resin. The CE media is then ready for regeneration which involves converting the uranium on the CE media to an anionic uranyl carbonate using an alkali carbonate (primary regeneration solution) as described herein.

RC can also take place during the secondary regeneration pretreatment step of the secondary CIX process of the dual cycle CIX process. Similar to the primary CIX process, RC can begin after the AE media (the secondary CIX media) loaded with uranyl carbonate complex has been washed with a small amount of water. A portion of the uranium loaded secondary regeneration solution (for example, uranyl sulfate solution), from storage/recycling of a previous cycle or from the initial start-up, is pH adjusted with a dilute base solution and applied to the AE media. The pH adjustment converts the uranium in the solution to an anionic form so that it has an affinity for and can be reloaded onto the AE media. Due to the affinity of uranium for the media relative to the other ions present, the uranium in the crowd solution displaces the non-uranium contaminants, which results in the AE media being more completely loaded with uranium before regeneration.

Examples of bases that can be used in the secondary CIX process include ammonium hydroxide, sodium hydroxide, and potassium hydroxide. In embodiments, ammonium hydroxide is used because it is compatible with the overall process system.

After "crowding" of the impurities off the resin, and replacement with the uranyl anion complex, the AE media is ready for regeneration which involves converting the uranium on the AE media to a cationic form using the secondary regeneration solution, a dilute sulfuric acid.

In embodiments, the RC system which performs the RC process includes one or more zones. In each zone, pH adjusted loaded regeneration solution from either the primary or secondary CIX systems, depending on which CIX the RC is being carried out in, is pH adjusted and then applied to either the CE or AE media to remove the contaminants. The pH adjusted primary or secondary regeneration solution can be obtained from another zone, such as a later zone in the sequence of zones, that the chamber containing CE or AE media moves through during the regeneration process. Following the RC section of the CIX system before regeneration, the solid media chambers then move through the regeneration zones following RC. The RC section for each CIX system, either CE or AE, can consist of any number of ion exchange zones, but typically the RC section would have one to five zones. The number of zones depends on specific operating characteristics of the CIX, either CE or AE. Following the RC portion of the CIX, the "crowded" resin is then treated in the regeneration section of the CIX where it is contacted with the chosen regeneration solution. For this system ammonium carbonate solution would be used for the CE and diluted sulfuric acid used for the AE.

FIG. 4 shows an example of the RC system and process including zones and used with the secondary CIX process to remove anionic contaminants. The secondary CIX (AE) media carries out the uranium extraction via an anion exchange with sulfate $(SO_4)^{-2}$. After washing, AE media (1) loaded with uranyl carbonate complex (from the primary regeneration solution) enters Zone X of the RC process. The AE media (1) is contacted with the solution that exits Zone X-1, which is fed forward to Zone X. This provides for counter-current contacting, as mentioned above, to provide for increased efficiency with the minimum amount of solution used. The spent RC solution exiting Zone X (2) contains the bulk of the impurities.

The crowding solution, the solution that exits Zone X-1, can be prepared by taking a portion of the uranium loaded secondary regeneration solution exiting Zone X-2 (6), adjusting it with a base (3), to raise its pH, and moving this solution forward to Zone X-1. For this example, the base used is a solution of dilute ammonia since this material is compatible with the overall uranium recovery operation. Other bases can be used, such as sodium hydroxide, potassium hydroxide, and the like, but ammonia is chosen for convenience and ease of handling.

Due to the nature of uranium in the sulfate solution (the initial uranium loaded secondary regeneration solution), as the pH is increased slightly the uranium again takes on an anionic nature which once again has a higher affinity for the AE media than the other anions (contaminants). As the AE media moves from Zone X to Zone X-2, the pH adjusted solution contacts the AE media containing uranium and contaminants, and the anionic uranium in the pH adjusted solution displaces the non-uranium anions (contaminants) on the AE media since the anionic uranium has a higher affinity for the AE media than the non-uranium anions. The non-uranium anions are transferred to the solution phase. The pH adjusted solution leaving Zone X-1 is transferred to Zone X to produce a counter-current contact.

The displacement or pushing off the non-uranium anions by the higher affinity uranium anions provides a "crowding" effect because as the AE media load becomes completely loaded with different anions, the anions with the highest affinity for the AE media will displace, or crowd, the anions that have a lower affinity. These lower affinity anions then move into the solution phase. Since the uranium has the highest affinity for the AE, the crowding step can be quite efficient.

The spent RC solution (2) exiting Zone X is discharged from the secondary CIX system.

The uranium loaded secondary regeneration solution (6) from Zone X-2 is transferred to the secondary loaded regeneration precipitation system.

As the AE media moves from Zone X-2 to Zone X-4, it is being regenerated with a strong acid, such as sulfuric acid. The regenerated AE media (5) is then transferred to the post-regeneration water washing step and finally returned to the secondary CIX system, where it is again contacted with fresh, primary loaded regeneration solution obtained from the primary CIX system.

In embodiments, the dual cycle CIX apparatus (and process) includes a GE or RC system in the primary CIX or secondary CIX system. In embodiments, the dual cycle CIX apparatus (and process) includes a GE system and RC system, one in the primary CIX and one in the secondary CIX system.

Examples of contaminants that can be removed by the GE and RC process include ions of iron and phosphorus. There may be traces of other anion complexes that can be removed in the AE system but iron and phosphorus are the main items for consideration. Concerning, the CE primary CIX system, the operational concept is similar except in the CE case, a portion of the loaded primary regeneration solution (ammonium uranyl carbonate), is treated with a small amount of acid, e.g. $H_2SO_4$, then used to crowd the CE resin before the regeneration step. Again, under these conditions, the uranium in the lowered pH solution loads back onto the resin and displaces contaminating ions that have a lower affinity for the resin compared to uranium.

The uranium obtained from the processes described above would typically be recovered as a uranium oxide ($U_3O_8$) product. This material would be prepared as discussed above in the hydrogen peroxide precipitation system with subsequent calcination of the precipitated uranyl peroxide to produce the $U_3O_8$. Uranium could also be recovered as a diuranate compound.

The term "zone" or "port" or "system" can be used interchangeably to refer to a specific system used to perform a portion of the entire process. The term "subzone" or "subport" or "subsystem" refers to a portion of the system performing a sub-portion of a specific portion of the entire process. For the GE and RC systems, the terms "system" and "subsystem" are used interchangeably.

In embodiments, each of the systems (units) described herein, such as the single cycle CIX system, the primary CIX system and the secondary CIX system of the dual cycle CIX system, the GE system, and the RC system, can contain several zones, for example, one to 50 zones. Each of the systems can include one, two, three, four, or five zones. The systems can include one to ten zones, one to 50 zones, five to 45 zones, ten to 40 zones, 15 to 35 zones, 20 to 35 zones, 25 to 30 zones, or 24 to 32 zones. The zones are fixed feed and discharge points for the system, which do not move.

In embodiments, each of the systems described herein can have several resin chambers, for example, one to 50 resin chambers. Each of the systems can include one, two, three, four, or five zones. The systems can include one to ten zones, one to 50 zones, five to 45 zones, ten to 40 zones, 15 to 35 zones, 20 to 35 zones, 25 to 30 zones, or 24 to 32 zones. In embodiments, the resin remains in the chamber, and the resin chambers can move from zone to zone to provide a continuous process without any interruption. Each resin chamber remains within each CIX system or unit. For example, the resin chamber of the primary system does not move to the secondary system of the dual cycle.

As will be understood by one of ordinary skill in the art, each embodiment disclosed herein can comprise, consist essentially of or consist of its particular stated element, step, ingredient, or component. Thus, the terms "include" or "including" should be interpreted to recite: "comprise, consist of, or consist essentially of." The transition term "comprise" or "comprises" means includes, but is not limited to, and allows for the inclusion of unspecified elements, steps, ingredients, or components, even in major amounts. The transitional phrase "consisting of" excludes any element, step, ingredient, or component not specified. The transition phrase "consisting essentially of" limits the scope of the embodiment to the specified elements, steps, ingredients, or components and to those that do not materially affect the embodiment.

All numbers expressing quantities of ingredients, properties such as reagents, reaction conditions, and so forth used in the specification and claims are to be understood as being modified in all instances by the term "about," unless indicated to the contrary. Accordingly, the numerical parameters set forth in the specification and attached claims are approximations that may vary depending upon the desired properties sought to be obtained. At the very least, each numerical parameter should at least be construed in light of the number of reported significant digits and by applying ordinary rounding techniques. When further clarity is required, the term "about" has the meaning reasonably ascribed to it by a person skilled in the art when used in conjunction with a stated numerical value or range, i.e. denoting somewhat more or somewhat less than the stated value or range, to within a range of ±20% of the stated value; ±15% of the stated value; ±10% of the stated value; ±5% of the stated value; ±4% of the stated value; ±3% of the stated value; ±2% of the stated value; ±1% of the stated value; or ±any percentage between 1% and 20% of the stated value.

Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard deviation found in their respective testing measurements.

The terms "a," "an," "the" and similar referents used in the context of describing the invention (especially in the context of the following claims) are to be construed to cover both the singular and the plural, unless otherwise indicated herein or clearly contradicted by context. Recitation of ranges of values herein is merely intended to serve as a shorthand method of referring individually to each separate value falling within the range. Unless otherwise indicated herein, each individual value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein is intended merely to better illuminate the invention and does not pose a limitation on the scope of the invention otherwise claimed. No language in the specification should be construed as indicating any non-claimed element essential to the practice of the invention.

Groupings of alternative elements or embodiments of the invention disclosed herein are not to be construed as limitations. Each group member may be referred to and claimed individually or in any combination with other members of the group or other elements found herein. It is anticipated that one or more members of a group may be included in, or deleted from, a group for reasons of convenience and/or patentability. When any such inclusion or deletion occurs, the specification is deemed to contain the group as modified thus fulfilling the written description of all Markush groups used in the appended claims.

The following exemplary embodiments and examples illustrate exemplary methods provided herein. These exemplary embodiments and examples are not intended, nor are they to be construed, as limiting the scope of the disclosure. It will be clear that the methods can be practiced otherwise than as particularly described herein. Numerous modifications and variations are possible in view of the teachings herein and, therefore, are within the scope of the disclosure.

EXEMPLARY EMBODIMENTS

The following are exemplary embodiments:

1. A single cycle continuous ion exchange (CIX) apparatus for recovering uranium including the following:
   a) a primary CIX system including a gradient elution (GE) or resin crowding (RC) system;
   b) a primary regeneration solution evaporation system;
   c) a uranyl precipitate filtration/washing/digestion system;
   d) an acidified uranyl salt solution precipitation system; and
   e) a precipitated uranium washing/calcining system;
   optionally, the primary CIX system includes a GE or an RC system; and
   optionally, the single cycle CIX apparatus includes a uranium product storage and automatic packaging system.
2. The single cycle CIX apparatus of embodiment 1, wherein the primary regeneration solution evaporation system includes a recovery condenser to recover decomposed compounds, for example, ammonia.
3. A dual cycle CIX apparatus for recovering uranium including the following:
   a) a primary CIX system including a GE or RC system;
   b) a secondary CIX system including a GE or RC system;

c) a secondary regeneration solution precipitation system;

d) a uranyl precipitate filtration/washing/digestion system; and e) a precipitated uranium washing/calcining system;

optionally, the primary and/or secondary CIX system includes a GE or RC system;

optionally, the single cycle CIX apparatus includes a uranium product storage and automatic packaging system.

4. The single cycle or dual cycle CIX apparatus of any one of embodiments 1-3, wherein the apparatus further includes a pretreatment system before the primary CIX system, the pretreatment system including clay addition system/step, flocculent addition system/step, and/or clarification system/step.

5. The single cycle or dual cycle CIX apparatus of any one of embodiments 1-4, wherein the primary CIX system includes a complexing cationic exchange (CE) media.

6. The dual cycle CIX apparatus of any one of embodiments 3-5, wherein the secondary CIX system includes an anionic exchange (AE) media.

7. The single cycle or dual cycle CIX apparatus of any one of embodiments 1-6 wherein the system enables recycling, return, or storage of solutions.

8. The single or dual cycle CIX apparatus of any one of embodiments 1-7, wherein the system allows for routine cleaning of the solid media of the primary CIX and/or the secondary CIX.

9. The single or dual cycle CIX apparatus of embodiment 8, wherein the primary and secondary CIX systems have at least 1 zone in the system which is operated in an up-flow mode to enable expansion of the solid media for cleaning at least one time per full cycle of the CIX system.

10. The single or dual cycle CIX apparatus of any one of embodiments 1-9, wherein the systems are connected sequentially for the recovery of uranium from a source.

11. A method of recovering uranium, wherein the method includes:

a) providing a source of uranium;

b) providing one or more CIX systems including a solid media that binds uranium;

c) applying the source of uranium to the solid media under conditions that cause the uranium to bind to the solid media; and d) recovering the uranium by a single cycle or dual cycle CIX process;

wherein the single cycle CIX process includes a GE or an RC process; and wherein the dual cycle ion exchange process includes a GE and/or an RC process.

12. The method of embodiment 11, wherein the CIX system is the primary CIX system of a single cycle CIX apparatus.

13. The method of embodiment 11, wherein there are two CIX systems and the two CIX systems are the primary and secondary CIX systems of a dual cycle CIX apparatus.

14. The method of any one of embodiments 11-13, wherein the primary CIX system includes a complexing cationic exchange (CE) resin that binds uranium.

15. The method of embodiment 11 or 13, wherein the secondary CIX system includes an anionic exchange (AE) resin that binds uranium.

16. The method of any one of embodiments 11-15, wherein the method further includes pretreating the source of uranium before step c).

17. The method of embodiment 16, wherein pretreating includes filtering or clarifying the source of uranium using an activated clay, an activated carbon, an activated silica, a flocculent, or a combination thereof.

18. The method of any one of embodiments 11-17, wherein the source of uranium is a source of phosphoric acid including uranium in any oxidation state.

19. The method of any one of embodiments 11-18, wherein the source of uranium includes a phosphoric acid solution or phos-acid feedstock.

20. The method of any one of embodiments 11-19, wherein the CE media includes:

a weakly acidic CE media with chelating aminomethyl phosphonic acid groups;

an aminophosphonic chelating media;

a macroporous polystyrene based chelating media with iminodiacetic groups; or a composition or material including an agent having chelating groups, functionalities, or moieties that bind uranium or includes iminodiacetic groups, chelating aminomethyl phosphonic acid groups, or aminophosphonic groups, wherein optionally, the composition or material includes beads, wires, meshes, nanobeads, nanotubes, or hydrogels.

21. The method of any one of embodiments 11-20, wherein recovering the uranium by a single cycle ion exchange process or by a dual cycle ion exchange process includes pretreating the CE media with an alkali solution to neutralize free acid in the CE media and followed by regenerating the CE media with an alkali carbonate solution at a pH that is greater than about 9.0, to produce a uranium loaded primary regeneration solution and a regenerated CE media.

22. The method of embodiment 21, wherein the alkali solution for pretreating the CE media includes ammonium hydroxide or sodium hydroxide.

23. The method of embodiment 21 or 22, wherein in pretreating the CE media, at least 1 zone is carried out in an up-flow operational mode to allow for purging of traces of solids from the CIX system.

24. The method of any one of embodiments 21-23, wherein regenerating the CE media with an alkali carbonate solution includes converting the uranium to an anionic uranyl carbonate complex and producing the uranium loaded primary regeneration solution including the anionic uranyl carbonate complex, and wherein the alkali carbonate solution includes ammonium carbonate, sodium carbonate, or potassium carbonate.

25. The method of any one of embodiments 21-24, wherein regenerating the CE media further includes washing the regenerated CE media with water or a slightly acidic solution before reentry of the CE media into the CIX process.

26. The method of any one of embodiments 21-25, wherein the single cycle ion exchange process further includes pretreating the CE media with an alkali solution including a portion of an initial regeneration solution, thereby reloading uranium contained in the initial regeneration solution onto the CE media.

27. The method of any one of embodiments 21-27, wherein the single cycle ion exchange process further includes concentrating the uranium loaded primary regeneration solution in an evaporation unit to reduce the water content, decomposing excess alkali carbonate to form bicarbonates, and reducing the pH of the solution to form a uranyl precipitate, wherein the alkali carbonate is ammonium carbonate, sodium carbonate, or potassium carbonate, optionally the alkali carbonate is ammonium carbonate and the uranyl precipitate is ammonium uranyl tricarbonate.

28. The method of embodiment 27, wherein the method further includes filtering the uranyl precipitate followed by washing the precipitate with water to remove excess alkali carbonate or entrained carbonate/bicarbonate from the uranyl precipitate.

29. The method of embodiment 27 or 28, wherein the method further includes recovering compound evolved in the decomposition of excess alkali carbonate, and recycling the recovered compound and resulting solution to the CIX apparatus, optionally, the compound evolved is ammonia.

30. The method of any one of embodiments 27-29, wherein the method further includes digesting the uranyl precipitate with an acid solution to produce a uranyl salt solution, and wherein optionally the acid solution includes sulfuric acid, nitric acid, or hydrochloric acid.

31. The method of embodiment 30, wherein the method further includes treating the uranyl salt solution with an alkali solution to raise the pH of the solution from about pH 2.5 to about pH 7, or from about pH 3.5 to about pH 6, to obtain a pH adjusted solution, wherein optionally, the alkali solution includes an alkali hydroxide, and wherein optionally the alkali solution has a pH greater than about pH 10.

32. The method of embodiment 31, wherein the method further includes adding an agent to the pH adjusted solution in an amount sufficient to form a precipitate, wherein the agent is hydrogen peroxide, ammonium hydroxide, ammonium carbonate, sodium hydroxide, sodium carbonate, or potassium hydroxide, optionally the agent is hydrogen peroxide and the precipitate is a uranyl peroxide precipitate.

33. The method of embodiment 32, wherein the method further includes separating the precipitate from the pH adjusted solution, by (i) settling, filtering, or centrifuging the precipitate, followed by washing the precipitate with water, or (ii) washing the precipitate on a filter, or repulping the precipitate with water, followed by settling, filtering, or centrifuging the precipitate; and wherein optionally, the method further includes additional washing of the precipitate with water.

34. The method of embodiment 32, wherein the method further includes drying the precipitate to form a dry solid.

35. The method of embodiment 34, wherein the method further includes heating the dry solid to a temperature sufficient to decompose or calcine the dry solid, optionally the dry solid is uranyl peroxide, and calcining the dry solid forms uranium oxide.

36. The method of any one of embodiments 21-25, wherein the dual cycle ion exchange process further includes treating the uranium loaded primary regeneration solution in a second CIX system including an anion exchange (AE) media, and wherein the anionic uranyl carbonate complex is transferred to the AE media.

37. The method of embodiment 36, wherein the AE media includes a functional group including a Type 1 quaternary ammonium.

38. The method of embodiment 36 or 37, wherein the method further includes treating the AE media with a water solution to produce a washed AE media.

39. The method of embodiment 38, wherein the method further includes treating the washed AE media with an acidic solution to remove uranium from the AE media to produce a uranium loaded secondary regeneration solution containing the uranium in a cationic form and a regenerated AE media, and wherein optionally, the acidic solution includes a dilute sulfuric acid, nitric acid, or hydrochloric acid.

40. The method of embodiment 39, wherein treating the washed AE media with the acidic solution is carried out in an up-flow operational mode for at least one of the contacting steps (in at least one of the zones) to purge traces of any solids that may have accumulated in the CIX system.

41. The method of embodiment 39 or 40, wherein the method further includes treating the regenerated AE media with water.

42. The method of embodiment 41, wherein the method further includes post-treating the regenerated AE media with an alkali solution before its reentry into the second CIX system.

43. The method of any one of embodiments 36-42, wherein the method further includes treating the uranium loaded secondary regeneration solution with an alkali solution to raise the pH of the solution from about pH 2.5 to about pH 7, or from about pH 3.5 to about pH 6, to obtain a pH adjusted solution, wherein optionally, the alkali solution includes an alkali hydroxide, an ammonium hydroxide, or a sodium hydroxide, at a concentration ranging from 10% to about 30%; and wherein optionally, the alkali solution has a pH greater than pH 10.

44. The method of embodiment 43, wherein the method further includes adding an agent to the pH adjusted solution in an amount sufficient to form a precipitate, wherein the agent is hydrogen peroxide, ammonium hydroxide, ammonium carbonate, sodium hydroxide, sodium carbonate, or potassium hydroxide, optionally the agent is hydrogen peroxide and the precipitate is a uranyl peroxide precipitate.

45. The method of embodiment 44, wherein the method further includes separating the precipitate from the pH adjusted solution, by (i) settling, filtering, or centrifuging the precipitate, followed by washing the precipitate with water, or (ii) washing the precipitate on a filter or repulping the precipitate with water, followed by settling, filtering, or centrifuging the precipitate; and wherein optionally, the method further includes additional washing of the precipitate with water.

46. The method of embodiment 45, wherein the method further includes drying the precipitate to form a dry solid.

47. The method of embodiment 46, wherein the method further includes heating the dry solid to a temperature sufficient to decompose or calcine the dry solid, optionally the dry solid is uranyl peroxide, and calcining the dry solid forms uranium oxide.

48. The method of any one of embodiments 11-47, wherein the primary CIX system includes a GE or RC system.

49. The method of any one of embodiments 11, 13-26, and 36-47, wherein the secondary CIX system includes a GE or RC system.

50. The method of any one of embodiments 11, 13-26, 36-47, and 49, wherein the primary and secondary CIX systems include a GE and/or RC system.
51. The method of any one of embodiments 11-50, wherein the GE process performed in the primary CIX system of the single cycle or dual cycle CIX process includes applying a dilute basic solution to the primary CE media during the regeneration pretreatment step which takes place after the primary CE media is loaded with uranium and before regeneration of the primary CE media.
52. The method of embodiment 51, wherein the GE process includes applying increasing strength of the dilute basic solution to remove non-uranium cations from the primary CE media.
53. The method of embodiment 51 or 52, wherein the dilute basic solution includes dilute carbonate solutions such as dilute ammonium carbonate solution, dilute sodium carbonate solution, or dilute potassium carbonate solution, optionally, the selected dilute basic solution includes ammonium carbonate solution.
54. The method of any one of embodiments 11-50, wherein the RC process performed in the primary CIX system of the single cycle or dual cycle CIX process includes adjusting with a dilute acid, the pH of a portion of the uranium loaded primary regeneration solution to obtain a crowd solution.
55. The method of embodiment 54, wherein the portion of the uranium loaded primary regeneration solution is obtained from an initial application of the primary regeneration solution to the primary CE media or from a recycled/stored uranium loaded regeneration solution of low purity.
56. The method of embodiments 54 or 55, wherein adjusting the pH of a portion of the uranium loaded primary regeneration solution converts the uranium in solution to a cationic form to obtain a crowd solution.
57. The method of embodiment 56, wherein the RC process further includes applying the crowd solution onto the primary CE media during the regeneration pretreatment step which takes place after the primary CE media is loaded with uranium and before the regeneration of the primary CE media.
58. The method of embodiment 57, wherein applying the crowd solution onto the primary CE media reloads the uranium onto the primary CE media and displaces the non-uranium contaminants from the primary CE media.
59. The method of any one of embodiments 11, 13-26, and 36-57, wherein the GE process performed in the secondary CIX system of the dual cycle CIX process includes applying a weak acidic solution to the secondary AE media during the regeneration pretreatment step which takes place after the secondary AE media is loaded with uranium and before regeneration of the secondary AE media.
60. The method of embodiment 59, wherein the GE process includes applying increasing strength of the weak acidic solution to remove non-uranium anions from the secondary AE media.
61. The method of embodiment 59 or 60, wherein the weak acidic solution includes weak sulfuric acid solution, weak hydrochloric acid solution, or weak nitric acid solution.
62. The method of any one of embodiments 11, 13-26, and 36-58, wherein the RC process performed in the secondary CIX system of the dual cycle CIX process includes adjusting with a weak base, the pH of a portion of the uranium loaded secondary regeneration solution to obtain a crowd solution.
63. The method of embodiment 62, wherein the portion of the uranium loaded secondary regeneration solution is obtained from an initial application of the secondary regeneration solution to the secondary AE media or from recycled/stored uranium loaded regeneration solution of low purity.
64. The method of embodiments 62 or 63, wherein adjusting the pH of the portion of the uranium loaded secondary regeneration solution converts the uranium in solution to an anionic form to obtain a crowd solution.
65. The method of embodiment 64, wherein the RC process further includes applying the crowd solution onto the secondary AE media during the regeneration pretreatment step which takes place after the secondary AE media is loaded with uranium and before regeneration of the secondary AE media.
66. The method of embodiment 65, wherein applying the crowd solution onto the secondary AE media reloads the uranium onto the secondary AE media and displaces the non-uranium contaminants from the secondary AE media.
67. The single cycle CIX system or dual cycle CIX system of any one of embodiments 1-10, wherein the GE or RC system includes one or more zones.
68. The single cycle CIX system or dual cycle CIX system of embodiment 67, wherein the GE system includes different zones for applying a different strength of acid or base to the solid media.
69. The single cycle CIX system or dual cycle CIX system of embodiment 67, wherein the RC system includes different zones for applying pH adjusted secondary regeneration solution.
70. The single cycle CIX system or dual cycle CIX system of any one of embodiment 67-69, wherein the GE or RC system includes zones for regenerating the AE or CE media.

Certain embodiments of this invention are described herein, including the best mode known to the inventors for carrying out the invention. Of course, variations on these described embodiments will become apparent to those of ordinary skill in the art upon reading the foregoing description. The inventor expects skilled artisans to employ such variations as appropriate, and the inventors intend for the invention to be practiced otherwise than specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

The subject matter described above is provided by way of illustration only and should not be construed as limiting. Various modifications and changes may be made to the subject matter described herein without following the example embodiments and applications illustrated and described, and without departing from the true spirit and scope of the present invention, which is set forth in the following claims.

All publications, patents and patent applications cited in this specification are incorporated herein by reference in their entireties as if each individual publication, patent or patent application were specifically and individually indicated to be incorporated by reference. While the foregoing has been described in terms of various embodiments, the skilled artisan will appreciate that various modifications, substitutions, omissions, and changes may be made without departing from the spirit thereof.

The invention claimed is:

1. A method of recovering uranium, wherein the method comprises:

a) providing a source of uranium;

b) providing one or more CIX systems including a solid media that binds uranium;

c) applying the source of uranium to the solid media under conditions that cause the uranium to bind to the solid media; and d) recovering the uranium by a single cycle or dual cycle CIX process;

wherein the single cycle CIX process comprises a single CIX system which is a primary CIX system comprising a primary chelating or complexing cationic exchange (CE) media that binds uranium and the single cycle CIX system further comprises a gradient elution (GE) system or a resin crowding (RC) system; or wherein the dual cycle CIX process comprises two CIX systems which include the primary CIX system comprising a CE media that binds uranium and a secondary CIX system comprising an anionic exchange (AE) media that binds uranium and wherein the dual cycle CIX system further comprises a GE system and/or an RC system; and wherein the GE process performed in the primary CIX system of the single cycle or dual cycle CIX process comprises applying a dilute basic solution to the CE media during a regeneration pretreatment step of the primary CIX system; or wherein the RC process performed in the primary CIX system of the single cycle or dual cycle CIX process comprises adjusting the pH of a portion of a uranium loaded primary regeneration solution with a dilute acid to obtain a crowd solution;

optionally, the method further comprises pretreating the source of uranium before step c), and optionally wherein pretreating comprises filtering or clarifying the source of uranium using an activated clay, an activated carbon, an activated silica, a flocculent, or a combination thereof.

2. The method of claim 1, wherein the CE media comprises a weakly acidic CE media with chelating aminomethyl phosphonic acid groups, an aminophosphonic chelating media, a macroporous polystyrene based chelating media with iminodiacetic groups, or a composition or material including an agent having chelating groups, functionalities, or moieties that bind uranium or comprises iminodiacetic groups, chelating aminomethyl phosphonic acid groups, or aminophosphonic groups, and optionally wherein the composition or material comprises beads, wires, meshes, nanobeads, nanotubes, or hydrogels; and wherein the AE media comprises a functional group including a Type 1 quaternary ammonium, a functional group including a type II quaternary ammonium, or a composition or material comprising an agent having one or more chelating groups, functionalities, or moieties, and optionally, the composition or material comprises beads, wires, meshes, nanobeads, nanotubes, nanowires or other nano-structures, or hydrogels.

3. The method of claim 1, wherein the source of uranium is a source of phosphoric acid comprising uranium in any oxidation state.

4. The method of claim 1, wherein recovering the uranium by a single cycle CIX process or by a dual cycle CIX process comprises pretreating the CE media with an alkali solution to neutralize free acid in the CE media and followed by regenerating the CE media with an alkali carbonate solution at a pH that is greater than about 9.0, to produce a uranium loaded primary regeneration solution and a regenerated CE media, and optionally wherein the alkali solution for pretreating the CE media comprises ammonium hydroxide or sodium hydroxide.

5. The method of claim 4, wherein regenerating the CE media with an alkali carbonate solution comprises converting the uranium to an anionic uranyl carbonate complex and producing the uranium loaded primary regeneration solution comprising the anionic uranyl carbonate complex, wherein the alkali carbonate solution comprises ammonium carbonate, sodium carbonate, or potassium carbonate, and optionally wherein regenerating the CE media further comprises washing the regenerated CE media with water or a slightly acidic solution before reentry of the CE media into the CIX process.

6. The method of claim 4, wherein the single cycle CIX process further comprises concentrating the uranium loaded primary regeneration solution in an evaporation unit to reduce the water content, decomposing excess alkali carbonate, and followed by reducing the pH of the solution to form a uranyl precipitate, and optionally wherein the method further comprises filtering the uranyl precipitate followed by washing the precipitate with water to remove excess alkali carbonate or entrained carbonate/bicarbonate from the uranyl precipitate.

7. The method of claim 6, wherein the method further comprises digesting the uranyl precipitate with an acid solution to produce a uranyl salt solution, and optionally wherein the acid solution comprises sulfuric acid, nitric acid, or hydrochloric acid.

8. The method of claim 7, wherein the method further comprises treating the uranyl salt solution with an alkali solution to raise the pH of the solution from about pH 2.5 to about pH 7, or from about pH 3.5 to about pH 6, to obtain a pH adjusted solution, optionally wherein the alkali solution comprises an alkali hydroxide, and optionally wherein the alkali solution has a pH greater than about pH 10.

9. The method of claim 8, wherein the method further comprises adding hydrogen peroxide to the pH adjusted solution in an amount sufficient to form a uranyl peroxide precipitate, optionally wherein the method further comprises separating uranyl peroxide precipitate from the pH adjusted solution, by (i) settling, filtering, or centrifuging the precipitate, followed by washing the precipitate with water, or (ii) washing the precipitate on a filter or repulping the precipitate with water, followed by settling, filtering, or centrifuging the precipitate; and optionally wherein the method further comprises additional washing of the uranyl peroxide precipitate with water.

10. The method of claim 9, wherein the method further comprises drying the uranyl peroxide precipitate to form a dry solid.

11. The method of claim 10, wherein the method further comprises heating the dry solid to a temperature sufficient to decompose or calcine the dry solid to form uranium oxide.

12. The method of claim 5, wherein the dual cycle CIX process further comprises treating the uranium loaded primary regeneration solution in the secondary CIX system including the AE media, and wherein the anionic uranyl carbonate complex is transferred to the AE media.

13. The method of claim 12, wherein the method further comprises treating the AE media with a water solution to produce a washed AE media.

14. The method of claim 13, wherein the method further comprises treating the washed AE media with an acidic solution to remove uranium from the AE media to produce a uranium loaded secondary regeneration solution containing the uranium in a cationic form and a regenerated AE media, and optionally wherein the acidic solution comprises a dilute sulfuric acid, nitric acid, or hydrochloric acid.

15. The method of claim 14, wherein the method further comprises treating the uranium loaded secondary regeneration solution with an alkali solution to raise the pH of the solution from about pH 2.5 to about pH 7, or from about pH 3.5 to about pH 6, to obtain a pH adjusted solution, optionally wherein the alkali solution comprises an alkali hydroxide, an ammonium hydroxide, or a sodium hydroxide, at a concentration ranging from 10% to about 30%; and optionally wherein the alkali solution has a pH greater than pH 10.

16. The method of claim 15, wherein the method further comprises adding hydrogen peroxide to the pH adjusted solution in an amount sufficient to form a uranyl peroxide precipitate, optionally wherein the method further comprises separating uranyl peroxide precipitate from the pH adjusted solution, by (i) settling, filtering, or centrifuging the precipitate, followed by washing the precipitate with water, or (ii) washing the precipitate on a filter or repulping the precipitate with water, followed by settling, filtering, or centrifuging the precipitate; and optionally wherein the method further comprises additional washing of the uranyl peroxide precipitate with water.

17. The method of claim 16, wherein the method further comprises drying the uranyl peroxide precipitate to form a dry solid.

18. The method of claim 17, wherein the method further comprises heating the dry solid to a temperature sufficient to decompose or calcine the dry solid to form uranium oxide.

19. The method of claim 1, wherein the primary CIX system comprises a GE system or an RC system, wherein the secondary CIX system comprises a GE system or an RC system, or wherein the primary and secondary CIX systems comprise a GE and/or RC system.

20. The method of claim 1, wherein the GE process comprises applying increasing strength of the dilute basic solution to remove non-uranium cations from the primary CE media, and optionally wherein the dilute basic solution comprises ammonium carbonate solution, dilute sodium carbonate solution, or dilute potassium carbonate solution.

21. The method of claim 1, wherein in the RC process the portion of the uranium loaded primary regeneration solution is obtained from an initial application of the primary regeneration solution to the primary CE media or from recycled/stored uranium loaded regeneration solution of low purity.

22. The method of claim 21, wherein the RC process further comprises applying the crowd solution onto CE media during a regeneration pretreatment step of the primary CIX process.

23. The method of claim 1, wherein the GE process performed in the secondary CIX system of the dual cycle CIX process comprises applying a weak acidic solution to the secondary AE media in the secondary CIX system during a regeneration pretreatment step.

24. The method of claim 23, wherein the GE process comprises applying increasing strength of the weak acidic solution to remove non-uranium anions from the secondary AE media, and optionally wherein the weak acidic solution comprises weak sulfuric acid solution, weak hydrochloric acid solution, or weak nitric acid solution.

25. The method of claim 1, wherein the RC process performed in the secondary CIX system of the dual cycle CIX process comprises adjusting the pH of a portion of a uranium loaded secondary regeneration solution with a weak base to obtain a crowd solution, and optionally wherein the portion of the uranium loaded secondary regeneration solution is obtained from an initial application of the uranium loaded secondary regeneration solution to a secondary AE media in the secondary CIX system or from recycled/stored uranium loaded regeneration solution of low purity.

26. The method of claim 25, wherein the RC process further comprises applying the crowd solution onto the secondary AE media during a regeneration pretreatment step which takes place after the secondary AE media is loaded with uranium and before regeneration of the secondary AE media.

* * * * *